US009286834B2

(12) United States Patent
Yoon

(10) Patent No.: US 9,286,834 B2
(45) Date of Patent: Mar. 15, 2016

(54) ORGANIC LIGHT EMITTING DIODE DISPLAY DEVICE WITH THRESHOLD VOLTAGE COMPENSATION

(71) Applicant: LG Display Co., Ltd., Seoul (KR)

(72) Inventor: Joongsun Yoon, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 164 days.

(21) Appl. No.: 13/674,757

(22) Filed: Nov. 12, 2012

(65) Prior Publication Data

US 2013/0120228 A1 May 16, 2013

(30) Foreign Application Priority Data

Nov. 15, 2011 (KR) ..... 10-2011-0119194

(51) Int. Cl.
*G09G 3/32* (2006.01)

(52) U.S. Cl.
CPC ..... *G09G 3/3291* (2013.01); *G09G 3/3233* (2013.01); *G09G 2300/0819* (2013.01); *G09G 2300/0852* (2013.01); *G09G 2300/0866* (2013.01)

(58) Field of Classification Search
CPC ..... G09G 3/3233; G09G 2300/0819; G09G 2300/0866
USPC ..... 345/82
See application file for complete search history.

(56) References Cited

U.S. PATENT DOCUMENTS

2008/0198102 A1* 8/2008 Yamashita et al. ..... 345/76
2010/0033511 A1* 2/2010 Yamashita et al. ..... 345/690
2010/0265166 A1* 10/2010 Kang et al. ..... 345/76
2011/0181192 A1* 7/2011 Ono ..... 315/169.3

FOREIGN PATENT DOCUMENTS

CN 101866614 A 10/2010
CN 102047312 A 5/2011

OTHER PUBLICATIONS

State Intellectual Property Office of the People's Republic of China, First Office Action, Chinese Patent Application No. 201210457452.3, Sep. 1, 2014, twelve pages.

* cited by examiner

*Primary Examiner* — John Kirkpatrick
(74) *Attorney, Agent, or Firm* — Fenwick & West LLP

(57) ABSTRACT

An organic light emitting diode display device comprises: a plurality of pixels, wherein each of the pixels comprising: a driving TFT including a gate electrode coupled to a first node, a source electrode coupled to a second node, and a drain electrode coupled to a high-potential voltage source; an organic light emitting diode including an anode coupled to the second node and a cathode coupled to a low-potential voltage source; a first TFT in response to a first scan signal to connect the first node to a data line; a second TFT in response to a second scan signal to connect the first node to a first reference voltage source; a third TFT in response to an emission signal to connect the second node to the third node; and capacitors.

22 Claims, 17 Drawing Sheets

FIG. 4

| | N1 | N2 | N3 |
|---|---|---|---|
| t1 | REF1 | VDD_L | VDD_L |
| t2 | REF1 | REF1-Vth | REF1-Vth |
| t3 | DATA | REF1-Vth | REF1-Vth -C'(REF1-DATA) |
| t4 | DATA -[REF1-Vth-C'(REF1-DATA)-Voled_anode] | Voled_anode | Voled_anode |

FIG. 10

| | N1 | N2 | N3 |
|---|---|---|---|
| t1 | REF1 | REF2 | REF2 |
| t2 | REF1 | REF1-Vth | REF1-Vth |
| t3 | DATA | REF1-Vth | REF1-Vth -C'(REF1-DATA) |
| t4 | DATA -[REF1-Vth-C'(REF1-DATA)-Voled_anode] | Voled_anode | Voled_anode |

ORGANIC LIGHT EMITTING DIODE DISPLAY DEVICE WITH THRESHOLD VOLTAGE COMPENSATION

CROSS-REFERENCE TO RELATED APPLICATION

This application claims the benefit of Korean Patent Application No. 10-2011-0119194 filed on Nov. 15, 2011, which is incorporated herein by reference in its entirety.

BACKGROUND

1. Field

This document relates to an organic light emitting diode display device capable of compensating the threshold voltage of a driving thin film transistor (TFT).

2. Related Art

With the development of information society, the demand for various types of display devices for displaying an image is increasing. Various flat panel displays, such as a liquid crystal display, a plasma display panel, and an organic light emitting diode (OLED) display, have been recently used. Among the flat panel displays, the OLED display has excellent characteristics including a low voltage drive, a thin profile, a wide viewing angle, and a fast response time. Especially, an active matrix type OLED display for displaying an image on a plurality of pixels, which are arranged in a matrix form, has been widely used.

A display panel of the active matrix type OLED display comprises a plurality of pixels arranged in a matrix form. Each of the pixels comprises a scan thin film transistor (TFT) for supplying a data voltage of a data line in response to a scan signal of a scan line and a driving TFT for adjusting the amount of current supplied to an organic light emitting diode in accordance with a data voltage supplied to a gate electrode. The drain-source current Ids of the driving TFT supplied to the organic light emitting diode can be expressed by following equation:

$$I_{ds}=k'\cdot(V_{gs}-V_{th})^2 \quad (1)$$

where k' represents a proportionality coefficient determined by the structure and physical properties of the driving TFT, Vgs represents the gate-source voltage of the driving TFT, and Vth represents the threshold voltage of the driving TFT.

The threshold voltage Vth of the driving TFT of each of the pixels may have a different value due to a shift in the threshold voltage Vth caused by degradation of the driving TFT. In this case, the drain-source current Ids of the driving TFT depends upon the threshold voltage Vth of the driving TFT. Hence, the current Ids supplied to the organic light emitting diode differs from pixel to pixel even if the same data voltage is supplied to each of the pixels. Accordingly, there arises the problem that the luminance of light emitted from the organic light emitting diode of each of the pixels differs even if the same data voltage is supplied to each of the pixels. To solve this problem, various types of pixel structures for compensating the threshold voltage Vth of the driving TFT have been proposed.

FIG. 1 is a circuit diagram showing a part of a diode-connected threshold voltage compensation pixel structure. FIG. 1 depicts a driving TFT DT supplying current to an organic light emitting diode and a sensing TFT ST coupled between a gate node Ng and drain node Nd of the driving TFT DT. The sensing TFT ST allows for a connection between the gate node Ng and drain node Nd of the driving TFT DT during a threshold voltage sensing period of the driving TFT DT so that the driving TFT DT is driven by a diode. In FIG. 1, the driving TFT DT and the sensing TFT ST are illustrated as N-type MOSFET (Metal Oxide Semiconductor Field Effect Transistors).

Referring to FIG. 1, the gate node Ng and the drain node Nd are coupled during the threshold voltage sensing period in which the sensing TFT ST is turned on, thereby allowing the gate node Ng and the drain node Nd to float at substantially the same potential. If a voltage difference Vgs between the gate node Ng and a source node Ns is greater than a threshold voltage, the driving TFT DT forms a current path until the voltage difference Vgs between the gate node Vg and the source node Vs reaches the threshold voltage Vth of the driving TFT DT, and as a result, the voltage of the gate node Vg and the drain node Vd is discharged. However, if the threshold voltage Vth of the driving TFT DT is shifted to a negative voltage, the voltage difference Vgs between the gate node Vg and the source node Vs cannot reach the threshold voltage Vth of the driving TFT DT, even if the gate node Vg goes down to 0 V, because the threshold voltage Vth of the driving TFT DT is lower than 0 V. Consequently, if the threshold voltage Vth of the driving TFT DT is shifted to a negative voltage, the threshold voltage Vth of the driving TFT DT cannot be sensed. A negative shift refers to shifting the threshold voltage Vth of the driving TFT DT to a voltage lower than 0 V when the driving TFT DT is implemented as an N-type MOSFET. The negative shift usually occurs when a semiconductor layer of the driving TFT DT is formed of an oxide.

SUMMARY

The present invention has been made in an effort to provide an organic light emitting diode display device capable of sensing the threshold voltage of a driving TFT even when the threshold voltage of the driving TFT is shifted to a negative voltage.

An organic light emitting diode display device according to the present invention comprises: a display panel having a data line, a first scan line, a second scan line, and an emission line formed thereon and a plurality of pixels arranged in a matrix form, each of the pixels comprising: a driving TFT comprising a gate electrode coupled to a first node, a source electrode coupled to a second node, and a drain electrode coupled to a high-potential voltage source supplying a high-potential voltage; an organic light emitting diode comprising an anode coupled to the second node and a cathode coupled to a low-potential voltage source supplying a low-potential voltage; a first TFT that is turned on in response to a first scan signal of the first scan line to connect the first node to the data line; a second TFT that is turned in response to a second scan signal of the second scan line to connect the first node to a first reference voltage source supplying a first reference voltage; a third TFT that is turned on in response to an emission signal of the emission line to connect the second node to the third node; a first capacitor coupled between the first node and the third node; and a second capacitor coupled between the third node and the first reference voltage source.

The features and advantages described in this summary and the following detailed description are not intended to be limiting. Many additional features and advantages will be apparent to one of ordinary skill in the art in view of the drawings, specification and claims.

BRIEF DESCRIPTION OF THE DRAWINGS

FIG. 4 is a table showing changes in the voltages of nodes of a pixel.

FIG. 10 is a table showing changes in the voltages of nodes of a pixel.

DETAILED DESCRIPTION

Figure 1:
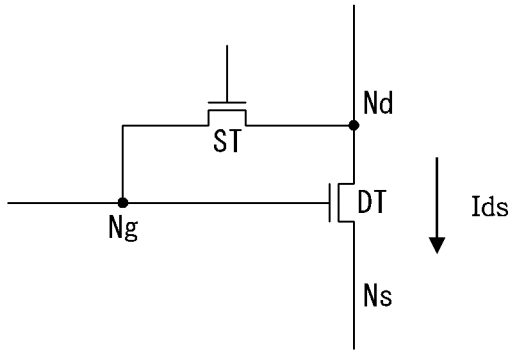
FIG. 1 is a circuit diagram showing a part of a diode-connected threshold voltage compensation pixel structure.

The invention will be described more fully hereinafter with reference to the accompanying drawings, in which exemplary embodiments of the invention are shown. This invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

A pixel of an organic light emitting diode display device according to an exemplary embodiment of the present invention can internally compensate the threshold voltage of a driving TFT and externally compensate the threshold voltage and electron mobility of the driving TFT and the threshold voltage of an organic light emitting diode. Internal compensation refers to sensing and compensating the threshold voltage of the driving TFT in real time within the pixel. External compensation refers to sensing the drain-source current of the driving TFT and the current of the organic light emitting diode, using the sensed current to compensate digital video data to be supplied to the pixel, and then supplying the compensated digital video data to the pixel. A description of the pixel internally compensating the threshold voltage of the driving TFT is given in conjunction with FIGS. 2 to 11, and a description of the pixel externally compensating the threshold voltage and electron mobility of the driving TFT and the threshold voltage of the organic light emitting diode is given in conjunction with FIGS. 12 to 14.

Figure 2:
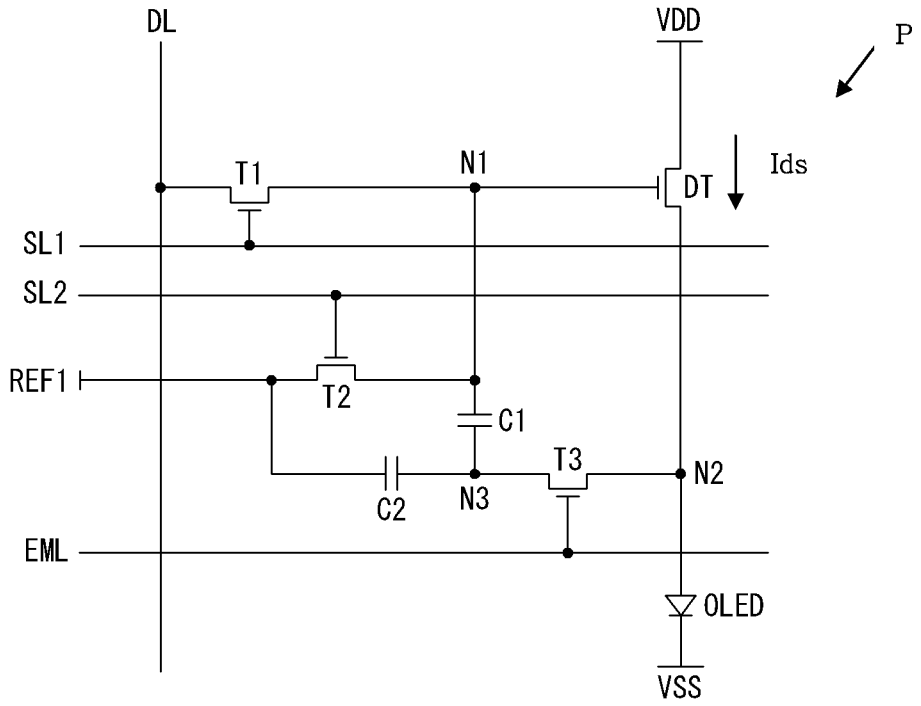
FIG. 2 is an equivalent circuit diagram of a pixel according to a first exemplary embodiment of the present invention.

FIG. 2 is an equivalent circuit diagram of a pixel according to a first exemplary embodiment of the present invention. Referring to FIG. 2, the pixel P according to the first exemplary embodiment comprises a driving TFT (thin film transistor) DT, an organic light emitting diode (OLED), a control circuit, and capacitors.

The driving TFT DT adjusts the amount of drain-source current Ids to differ according to the level of a voltage applied to a gate electrode. The gate electrode of the driving TFT DT is coupled to a first node N1, a source electrode thereof is coupled to a second node N2, and a drain electrode thereof is coupled to a high-potential voltage source supplying a high-potential voltage VDD.

An anode of the organic light emitting diode is coupled to the second node N2, a cathode thereof is coupled to a low-potential voltage source supplying a low-potential voltage VSS. The organic light emitting diode OLED emits light depending on the drain-source current Ids of the driving TFT DT.

The control circuit comprises first to third TFTs T1, T2, and T3. The first TFT T1 is turned on in response to a first scan signal SCAN1 supplied from a first scan line SL1 to connect the first node N1 to a data line DL supplying a data voltage DATA. A gate electrode of the first TFT T1 is coupled to the first scan line SL1, a source electrode thereof is coupled to the first node N1, and a drain electrode thereof is coupled to the data line DL.

The second TFT T2 is turned on in response to a second scan signal supplied from a second scan line SL2 to connect the first node N1 to a first reference voltage source supplying a first reference voltage REF1. A gate electrode of the second TFT T2 is coupled to the second scan line SL2, a source electrode thereof is coupled to the first reference voltage source, and a drain electrode thereof is coupled to the first node N1.

The third TFT T3 is turned on in response to an emission signal EM from an emission line EML to connect the second node N2 to the third node N3. A gate electrode of the third TFT T3 is coupled to the emission line EML, a source electrode thereof is coupled to the third node N3, and a drain electrode thereof is coupled to the second node N2.

The first capacitor C1 is coupled between the first node N1 and the third node N4, and stores a differential voltage between the first node N1 and the third node N3. The second capacitor C2 is coupled between the third node N3 and the first reference voltage source, and stores a differential voltage between the third node N3 and the first reference voltage source.

The first node N1 is a contact point at which the gate electrode of the driving TFT DT, the source electrode of the first TFT T1, the drain electrode of the second TFT T2, and one electrode of the first capacitor C1 are coupled. The second node N2 is a contact point at which the source electrode of the driving TFT DT, the anode of the organic light emitting diode, and the drain electrode of the third TFT T3 are coupled. The third node N3 is a contact point at which the source electrode of the third TFT T3, the other electrode of the first capacitor C1, and one electrode of the second capacitor C2 are coupled.

Semiconductor layers of the first to third TFTs T1, T2, and T3 and the driving TFT DT have been described as being formed of an oxide semiconductor, in particular, an oxide semiconductor. However, the present invention is not limited thereto, but the semiconductor layers of the first to third TFTs T1, T2, and T3 and the driving TFT DT may be formed of either a-Si or Poly-Si. Also, the exemplary embodiment of the present invention has been described with respect to an example in which the first to third TFTs T1, T2, and T3 and the driving TFT DT are implemented as N-type MOSFETs (Metal Oxide Semiconductor Field Effect Transistors).

After consideration of the characteristics of the driving TFT DT and the characteristics of the organic light emitting diode OLED, the high-potential voltage source is set to supply a high-potential voltage VDD swinging between a high level VDD_H and a low level VDD_L, and the low-potential voltage source is set to supply a DC low-potential voltage VSS. A high-potential voltage VDD_L of low level may be set to a voltage lower than a differential voltage between the first reference voltage REF1 and the threshold voltage Vth of the driving TFT DT. For example, a high-potential voltage VDD_H of high level may be set to approximately 20 V, the high-potential voltage VDD_L of low level may be set to approximately −7 V, the low-potential voltage VSS may be set to approximately 0 V, and the first reference voltage REF1 may be set to approximately −1 V.

Figure 3:
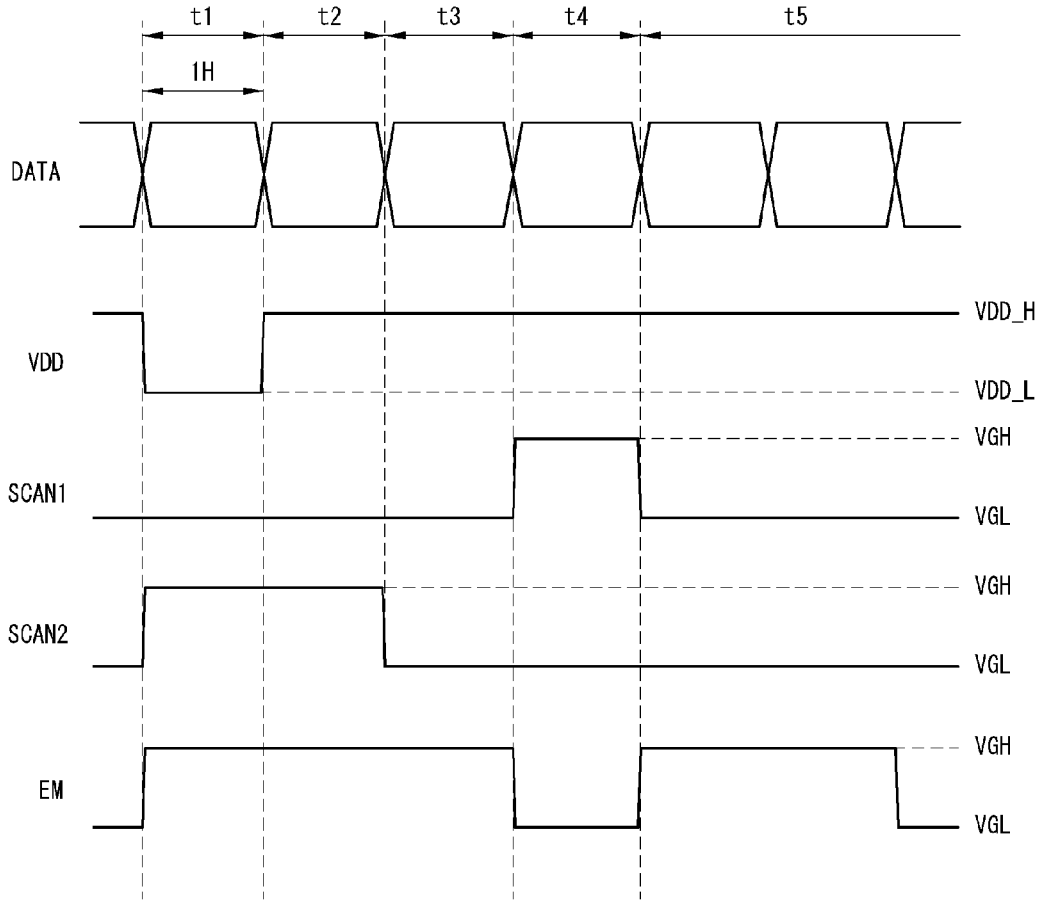
FIG. 3 is a waveform diagram showing signals which are input into a pixel to internally compensate the threshold voltage of a driving TFT.

FIG. 3 is a waveform diagram showing signals which are input into a pixel to internally compensate the threshold voltage of a driving TFT. FIG. 3 depicts first and second scan signals SCAN1 and SCAN2 and an emission signal EM which are input into a certain pixel P of a display panel 10. Moreover, FIG. 3 depicts a data voltage DATA supplied through a data line DL and a high-potential voltage VDD supplied from a high-potential voltage source.

Referring to FIG. 3, the first and second scan signals SCAN1 and SCAN2 and the emission signal EM are signals for controlling the first to third TFTs T1, T2, and T3 of the pixel P. The first and second scan signals SCAN1 and SCAN2 and the emission signal EM each are generated every frame period. The first and second scan signals SCAN1 and SCAN2 and the emission signal EM each swing between a gate high voltage VGH and a gate low voltage VGL. Pulses of the first and second scan signals SCAN1 and SCAN2 and the emission signal EM are generated at the gate high voltage VGH. Especially, two pulses are generated for the emission signal EM. The first pulse of the emission signal EM is generated during t1 and t2, and the second pulse thereof is generated during t4. The gate high voltage VGH may be set to a value approximately between 14 V and 20 V, and the gate low voltage VGL may be set to a value approximately between −12 V and −5V.

The pulse start time of the second scan signal SCAN2 is synchronized with the first pulse start time of the emission signal EM. The first pulse end time the emission signal EM is synchronized with the pulse start time of the first scan signal SCAN1. The pulse end time of the second scan signal SCAN2 is earlier than the first pulse end time of the emission signal EM. Moreover, the pulse end time of the first scan signal SCAN1 is synchronized with the second pulse start time of the emission signal EM. The second pulse of the emission signal EM is generated during several to several tens of horizontal periods. One horizontal period 1H refers to one line scanning time during which data is written in pixels of one horizontal line.

The pulse width of the second scan signal SCAN2 and the first pulse width of the emission signal EM are larger than the pulse width of the second scan signal SCAN2. For example, the pulse width of the first scan signal SCAN1 may be set to one horizontal period 1H, the pulse width of the second scan signal SCAN2 may be set to two horizontal periods 2H, and the first pulse width of the emission signal EM may be set to three horizontal periods 3H.

The driving TFT DT adjusts the amount of current supplied to the organic light emitting diode OLED according to the data voltage DATA. The data voltage DATA is generated every horizontal period 1H. The high-potential voltage VDD swings between the high level VDD_H and the low level VDD_L every frame period. The high-potential voltage VDD is generated at the low level VDD_L during t1 and at the high level VDDH during the remaining period. That is, the high-potential voltage source generates the high-potential voltage VDD at the low level VDD_L since the pulse start time of the second scan signal SCAN2, and generates the high-potential voltage VDD at the high level VDD_H from a point in time earlier than the pulse end time of the second scan signal SCAN2.

FIG. 4 is a table showing changes in the voltages of nodes of a pixel. Hereinafter, an operation of the pixel P during t1 to t5 according to an exemplary embodiment of the present invention will be described in detail with reference to FIGS. 2 to 4. t1 is a period during which the first to third nodes N1, N2, and N3 are initialized, t2 and t3 are periods for sensing the threshold voltage of the driving TFT DT, t4 is a period for supplying a data voltage, and t5 is a period during which the organic light emitting diode OLED emits light.

First, during t1, a pulse of the second scan signal SCAN2 and a first pulse of the emission signal EM start. That is, during t1, the first scan signal SCAN1 having the gate low voltage VGL is supplied through the first scan line SL1, the second scan signal SCAN2 having the gate high voltage VGH is supplied through the second scan line SL2, and the emission signal EM having the gate high voltage VGH is supplied through the emission line EML. Moreover, the high-potential voltage VDD_L of low level is supplied from the high-potential voltage source during t1.

The first TFT T1 is turned off in response to the first scan signal SCAN1 having the gate low voltage VGL. The second TFT T2 is turned on in response to the second scan signal SCAN2 having the gate high voltage VGH to connect the first node N1 to the first reference voltage source. By the turning on of the second TFT T2, the first node N1 is discharged to the first reference voltage REF1. The third TFT T3 is turned on in response to the emission signal EM of the gate high voltage VGH to connect the second node N2 to the third node N3. By the turning on of the third TFT T3, the second node N2 and the third node N3 have the same potential.

Because the high-potential voltage VDD_L of low level is supplied from the high-potential voltage source during t1, the drain electrode of the driving TFT DT coupled to the high-potential voltage source functions as a source electrode, and the source electrode of the driving TFT DT coupled to the second node N2 functions as a drain electrode. Accordingly, the voltage difference Vgs between the gate and source electrodes of the driving TFT is greater than the threshold voltage Vth during t1, thereby turning on the driving TFT DT. By the turning on of the driving TFT DT is turned on, the second node N2 is discharged to the high-potential voltage VDD_L of low level. Moreover, by the turning on of the third TFT T3, the third node N3 coupled to the second node N2 is also discharged to the high-potential voltage VDD_L of low level.

Secondly, during t2, the pulse of the second scan signal SCAN2 is sustained, and the first pulse of the emission signal EM is sustained. During t3, the pulse of the second scan signal SCAN2 ends, and the first pulse of the emission signal EM is sustained. That is, the first scan signal SCAN1 having the gate low voltage VGL is supplied through the first scan line SL1 during t2 and t3, the second scan signal SCAN2 having the gate high voltage VGH is supplied through the second scan line SL2 during t2, the second scan signal SCAN2 having the gate low voltage VGL is supplied through the second scan line SL2 during t3, and the emission signal EM having the gate high voltage VGH is supplied through the emission line EML during t2 and t3. Moreover, the high-potential voltage VDD_H of high level is supplied from the high-potential voltage source during t2 and t3.

The first TFT T1 is turned off in response to the first scan signal SCAN1 having the gate low voltage VGL. When the second scan signal SCAN2 is inverted to the gate low voltage VGL, the second TFT T2 is turned off. By the turning off of the first and second TFTs T1 and T2, the first node N1 is disconnected from the first reference voltage, and the first node N1 floats. The third TFT T3 is turned on in response to the emission signal EM having the gate high voltage VGH to connect the second node N2 to the third node N3. By the turning on of the third TFT T3, the second node N2 and the third node N3 have the same potential.

The high-potential voltage VDD_H of high level is supplied from the high-potential voltage source during t2 and t3. Because the voltage difference Vgs between the gate and source electrodes of the driving TFT DT is greater than the threshold voltage Vth, the driving TFT DT forms a current path until the voltage difference Vgs between the gate and source electrodes reaches the threshold voltage Vth. Accordingly, the voltage of the second node N2 rises up to a differential voltage REF1-Vth between the first reference voltage REF1 and the threshold voltage Vth of the driving TFT DT. Moreover, as the third node N3 is coupled to the second node N2 by the turning on of the third TFT T3, the voltage of the third node N3 rises up to the differential voltage REF1-Vth between the first reference voltage REF1 and the threshold voltage Vth of the driving TFT DT.

T3 may be defined as a floating period of the first node N1. As the first node N1 floats during t3, a change in the voltage of the second node N2 may be applied to the first node N1 by a parasitic capacitance existing between the gate electrode and source electrode of the driving TFT DT. Due to this, the voltage of the first node N1 is increased, thereby enhancing the sensing speed of the threshold voltage Vth of the driving TFT DT.

Consequently, the second node N2 and the third node N3 sense the threshold voltage Vth of the driving TFT DT during t2 and t3. Although FIG. 2 has been illustrated with respect to an example in which t2 and t3 corresponding to the threshold voltage sensing period are two horizontal periods, it is to be noted that the present invention is not limited thereto. That is, t2 and t3 may be appropriately set to approximately two or more horizontal periods by a preliminary test, and t3, which is the floating period of the first node N1, may be appropriately set to approximately 1 to several tens of horizontal periods by a preliminary test. A detailed description thereof will be described later with reference to FIG. 5. In the present invention, the threshold voltage Vth of the driving TFT DT is sensed during two or more horizontal periods, and therefore the accuracy of sensing the threshold voltage of the driving TFT DT can be increased even when a large area, high-resolution organic light emitting diode display device is driven at high speed at a frame frequency of 240 Hz or more.

Thirdly, during t4, the first pulse of the emission signal EM ends, and a pulse of the first scan signal SCAN1 starts. That is, during t4, the first scan signal SCAN1 having the gate high voltage VGH is supplied through the first scan line SL1, the second scan signal SCAN2 having the gate low voltage VGL is supplied through the second scan line SL2, and the emission signal EM having the gate low voltage VGL is supplied through the emission line EML. Moreover, the high-potential voltage VDD_H of high level is supplied from the high-potential voltage source during t4.

The first TFT T1 is turned on in response to the first scan signal SCAN1 having the gate high voltage VGH to connect the first node N1 to the data line DL. The second TFT T2 is turned off in response to the second scan signal SCAN2 having the gate low voltage VGL. By the turning on of the first TFT T1, the first node N1 is charged with the data voltage DATA. The third TFT T3 is turned off in response to the emission signal EM having the gate low voltage VGL. By the turning off of the third TFT T3, the second node N2 is disconnected from the third node N3, and the third node N3 floats.

As the third node N3 floats during t4, a change in the voltage of the first node N1 is applied to the third node N3 by the first capacitor C1. That is, 'REF1−DATA', the change in the voltage of the first node N1, is applied to the third node N3. However, the third node N3 is coupled between the first and second capacitors C1 and C2 coupled in series. Hence, the voltage change is applied in the ratio of C' as expressed in following equation:

$$C' = \frac{CA1}{CA1 + CA2} \tag{2}$$

where CA1 represents the capacitance of the first capacitor C1, and CA2 represents the capacitance of the second capacitor C2. As a consequence, 'C'(REF1−DATA)' is applied to the third node N3, and therefore the voltage of the third node N3 is changed to 'REF1−Vth−C'(REF1−DATA)'.

Fourthly, during t5, the pulse of the first scan signal SCAN1 ends, and a second pulse of the emission signal EM is generated. That is, during t5, the first scan signal SCAN1 having the gate low voltage VGL is supplied through the first scan line SL1, the second scan signal SCAN2 having the gate low voltage VGL is supplied through the second scan line SL2, and the emission signal EM inverted from the gate high voltage VGH to the gate low voltage VGL is supplied through the emission line EML. The emission signal EM is inverted to the gate low voltage VGL within approximately 1 to several tens of horizontal periods. Moreover, the high-potential voltage VDD_H of high level is supplied from the high-potential voltage source during t5.

The first TFT T1 is turned off in response to the first scan signal SCAN1 having the gate low voltage VGL. The second TFT T2 is turned off in response to the second scan signal SCAN2 having the gate low voltage VGL. By the turning off of the first TFT T1 and the second TFT T2, the first node N1 floats. The third TFT T3 is turned on in response to the emission signal EM having the gate high voltage VGH to connect the second node N2 to the third node N3. By the turning on of the third TFT T3, the voltage of the third node N3 is changed. The third TFT T3 is turned off in response to the emission signal EM inverted from the gate high voltage VGH to the gate low voltage VGL within 1 to several tens of horizontal periods.

As the first node N1 floats during t5, a change in the voltage of the third node N3 is applied to the first node N1 by the first capacitor C1. That is, 'REF1−Vth−C'(REF1−DATA)−Voled_anode', the change in the voltage of the third node N3, is applied to the first node N1. Accordingly, the voltage of the first node N1 is changed to 'DATA−{REF1−Vth−C'(REF1−DATA)−Voled_anode}'.

The drain-source current Ids of the driving TFT DT supplied to the organic light emitting diode OLED is expressed by the following equation:

$$I_{ds}=k'\cdot(V_{gs}-V_{th})^2 \quad (3)$$

where k' represents a proportionality coefficient determined by the structure and physical properties of the driving TFT, depending on the electron mobility of the driving TFT DT, channel width, channel length, etc. Vgs represents the voltage difference between the gate and source electrodes of the driving TFT, and Vth represents the threshold voltage of the driving TFT DT. 'Vgs−Vth' during t5 is as expressed in the following equation:

$$Vgs-Vth=[DATA-\{REF1-Vth-C'(REF1-DATA)-V_{oled\ anode}\}-V_{oled\ anode}]-Vth \quad (4)$$

To sum up Equation 4, the drain-source current Ids of the driving TFT DT is derived as expressed in the following equation:

$$I_{ds}=k'[(1+C')\cdot(DATA-REF1)]^2 \quad (5)$$

As a consequence, as shown in Equation 5, the drain-source current Ids of the driving TFT DT supplied to the organic light emitting diode OLED during t5 does not depend upon the threshold voltage Vth of the driving TFT DT. That is, the present invention makes it possible to compensate the threshold voltage of the driving TFT DT.

Overall, in the pixel P according to the first exemplary embodiment of the present invention, the high-potential voltage VDD is supplied at a low level during an initialization period t1 to initialize the second node N2 coupled to the source electrode of the driving TFT DT to the high-potential voltage VDD_L of low level. The high-potential voltage VDD_L of low level is set to a voltage lower than the differential voltage between the first reference voltage REF1 and the threshold voltage Vth of the driving TFT DT. As a result, the pixel P according to the first exemplary embodiment of the present invention allows the voltage difference Vgs between the gate and source electrodes of the driving TFT DT to be greater than the threshold voltage Vth during the threshold voltage sensing period (t2 and t3), even if the threshold voltage Vth of the driving TFT DT is shifted to a negative voltage. Due to this, the driving TFT DT forms a current path until the voltage difference Vgs between the gate and source electrodes reaches the threshold voltage Vth. Accordingly, the voltage of the second node N2 rises up to a differential voltage REF1-Vth between the first reference voltage REF1 and the threshold voltage Vth of the driving TFT DT. Therefore, even if the threshold voltage Vth of the driving TFT DT is shifted to a negative voltage, the second node N2 can sense the threshold voltage Vth. A negative shift refers to shifting the threshold voltage Vth of the driving TFT DT to a voltage lower than 0 V when the driving TFT DT is implemented as an N-type MOSFET.

Figure 5:
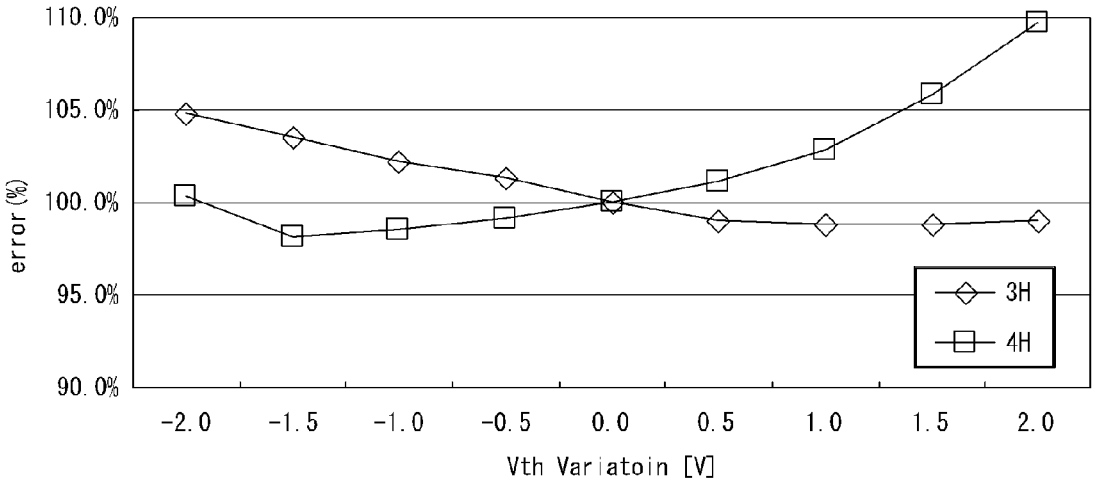
FIG. 5 is a graph showing a threshold voltage compensation error vs. a change in the threshold voltage of a driving TFT for each threshold voltage sensing period of the pixel according to the first exemplary embodiment of the present invention.

FIG. 5 is a graph showing a threshold voltage compensation error versus a change in the threshold voltage of a driving TFT for each threshold voltage sensing period of the pixel according to the first exemplary embodiment of the present invention. Referring to FIG. 5, a threshold voltage variation range (Vth variation) of the driving TFT DT is shown on the x-axis, and an error of the drain-source current of the driving TFT DT supplied to the organic light emitting diode OLED is shown on the y-axis.

Due to degradation of the driving TFT, the threshold voltage Vth of the driving TFT DT may be shifted by −2.0 V to +2.0 V from the reference value for each pixel P. Accordingly, in recent years, organic light emitting diode display devices allow the organic light emitting diode OLED to emit light, without depending on the threshold voltage Vth, by sensing the threshold voltage Vth of the driving TFT DT of each pixel P and compensating the threshold voltage Vth. However, if the accuracy of sensing the threshold voltage Vth of the driving TFT DT is low, the threshold voltage Vth sensed during the threshold voltage sensing period (t2 and t3) and an actual threshold voltage of the driving TFT DT are different. Thus, 'Vth' is not omitted from Equation 4. For this reason, an error occurs in the drain-source current Ids of the driving TFT DT supplied to the organic light emitting diode OLED.

FIG. 5 depicts an error in the drain-source current Ids of the driving TFT DT when a floating period t3 of the first node N, out of the threshold voltage sensing period t2 and t3 of the driving TFT, corresponds to three horizontal periods 3H and four horizontal periods 4H. When the floating period t3 of the first node N1 corresponds to three horizontal periods 3H, the error in the drain-source current Ids of the driving TFT DT occurs at about −2% to 5%. On the other hand, when the floating period t3 of the first node N1 is equal to four horizontal periods 4H, the error in the drain-source current Ids of the driving TFT DT occurs at −2% to 10%. That is, the floating period t3 of the first node N1 allows for improved sensing speed of the threshold voltage Vth of the driving TFT DT. Accordingly, in the first exemplary embodiment of the present invention, if the floating period t3 of the first node N1 is set to three horizontal periods 3H, as shown in FIG. 5, the accuracy of sensing the threshold voltage of the driving TFT DT can be improved, and therefore an error in the drain-source current Ids of the driving TFT DT can be minimized.

Figure 6:
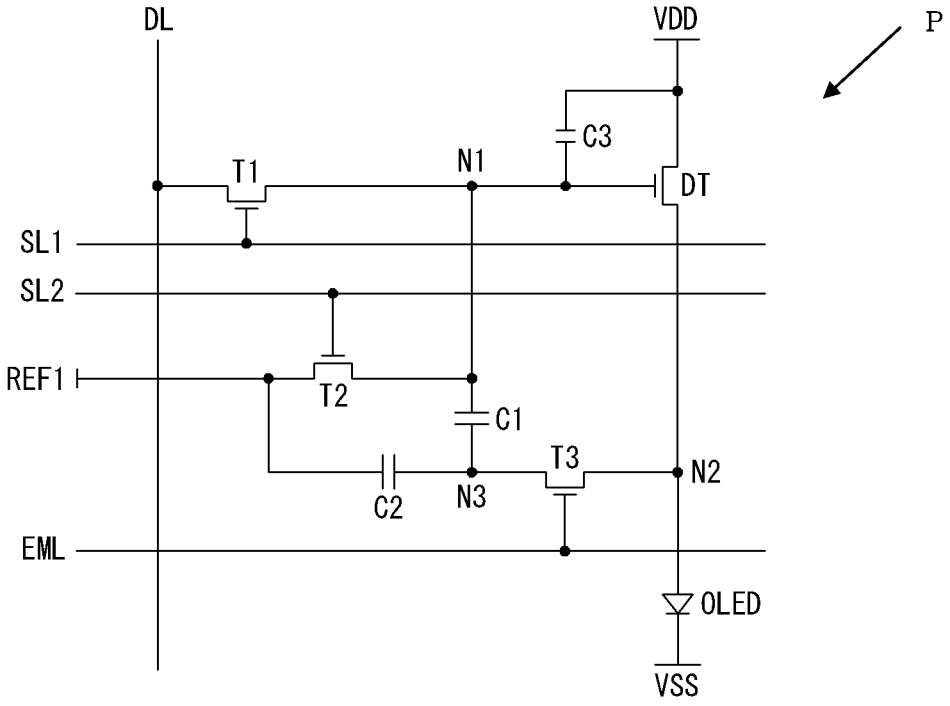
FIG. 6 is an equivalent circuit diagram of a pixel according to a second exemplary embodiment of the present invention.

FIG. 6 is an equivalent circuit diagram of a pixel according to a second exemplary embodiment of the present invention. Referring to FIG. 6, the pixel P according to the second exemplary embodiment comprises a driving TFT DT, an organic light emitting diode OLED, a control circuit, and capacitors. The control circuit comprises first to third TFTs T1, T2, and T3, and the capacitors comprise first to third capacitors C1, C2, and C3.

The structure and operating method of the pixel P according to the second exemplary embodiment of the present invention are substantially identical to those of the pixel P according to the first exemplary embodiment of the present invention described with reference to FIGS. 2 to 4, except for the third capacitor C3, so descriptions of the driving TFT DT, organic light emitting diode OLED, first to third TFTS T1, T2, and T3, and first and second capacitors C1 and C2 of the pixel P according to the second exemplary embodiment of the present invention will be omitted.

The third capacitor C3 is coupled between the first node 1 and the high-potential voltage source, and stores a differential voltage between the first node N1 and the high-potential voltage source. The third capacitor C3 prevents a change in the voltage of the second node N2 from being applied to the first node N1 by a parasitic capacitance of the driving TFT DT. This prevents an increase in the voltage of the first node N1, thereby enhancing grayscale representation capability. That is to say, a higher contrast ratio can be achieved.

Figure 7:
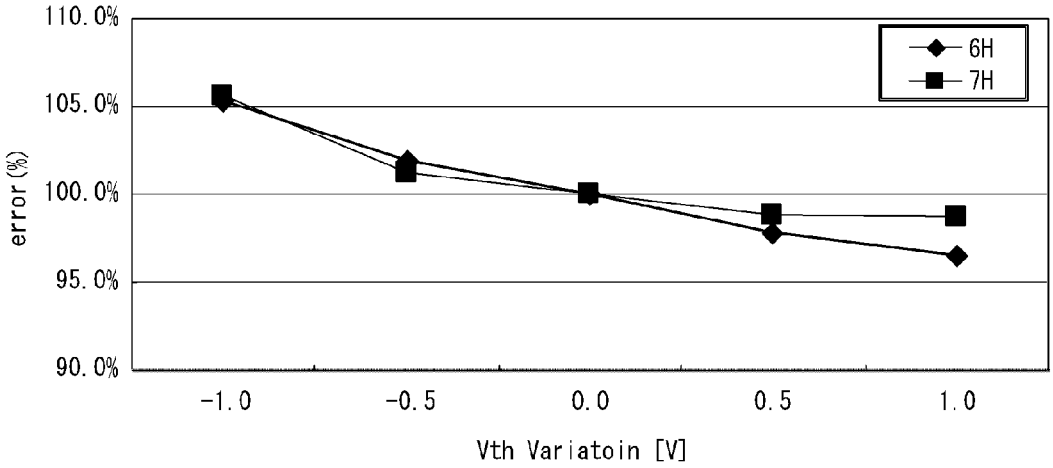
FIG. 7 is a graph showing a threshold voltage compensation error versus a change in the threshold voltage of a driving TFT for each threshold voltage sensing period of the pixel according to the second exemplary embodiment of the present invention.

FIG. 7 is a graph showing a threshold voltage compensation error versus a change in the threshold voltage of a driving TFT for each threshold voltage sensing period of the pixel according to the second exemplary embodiment of the present invention. Referring to FIG. 7, a threshold voltage variation range (Vth variation) of the driving TFT DT is shown on the x-axis, and an error of the drain-source current of the driving TFT DT supplied to the organic light emitting diode OLED is shown on the y-axis.

Due to degradation of the driving TFT, the threshold voltage Vth of the driving TFT DT may be shifted by −2.0 V to +2.0 V from the reference value for each pixel P. Accordingly, in recent years, organic light emitting diode display devices allow the organic light emitting diode OLED to emit light, without depending on the threshold voltage Vth, by sensing the threshold voltage Vth of the driving TFT DT of each pixel P and compensating the threshold voltage Vth. However, if the accuracy of sensing the threshold voltage Vth of the driving TFT DT is low, the threshold voltage Vth sensed during the threshold voltage sensing period (t2 and t3) and an actual threshold voltage of the driving TFT DT are different. Thus, 'Vth' is not omitted from Equation 4. For this reason, an error occurs in the drain-source current Ids of the driving TFT DT supplied to the organic light emitting diode OLED.

FIG. 7 depicts an error in the drain-source current Ids of the driving TFT DT when a floating period t3 of the first node N, out of the threshold voltage sensing period t2 and t3 of the driving TFT, corresponds to six horizontal periods 6H and seven horizontal periods 7H. When the floating period t3 of the first node N1 corresponds to six horizontal periods 6H, the error in the drain-source current Ids of the driving TFT DT occurs at about −3% to 5%. On the other hand, when the floating period t3 of the first node N1 is equal to seven horizontal periods 7H, the error in the drain-source current Ids of the driving TFT DT occurs at −1% to 5%. That is, the third capacitor C3 prevents a change in the voltage of the second node N2 from being applied to the first node N1 by the parasitic capacitance of the driving TFT DT. Accordingly, in the second exemplary embodiment of the present invention, as the floating period t3 of the first node N1 becomes longer as shown in FIG. 7, the accuracy of sensing the threshold voltage of the driving TFT DT becomes higher, and therefore an error in the drain-source current Ids of the driving TFT DT can be minimized.

Figure 8:
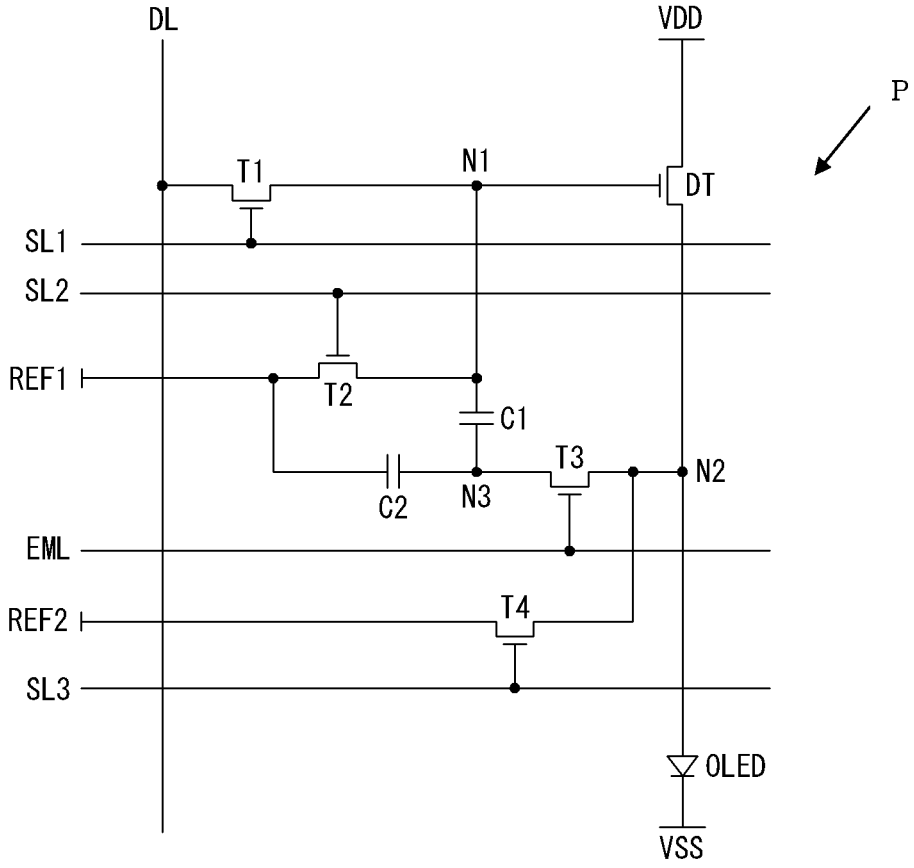
FIG. 8 is an equivalent circuit diagram of a pixel according to a third exemplary embodiment of the present invention.

FIG. 8 is an equivalent circuit diagram of a pixel according to a third exemplary embodiment of the present invention. Referring to FIG. 8, the pixel P according to the second exemplary embodiment comprises a driving TFT DT, an organic light emitting diode OLED, a control circuit, and capacitors. The control circuit comprises first to fourth TFTs T1, T2, T3, and T4, and the capacitors comprise first and second capacitors C1 and C2.

The structure and operating method of the pixel P according to the third exemplary embodiment of the present invention are substantially identical to those of the pixel P according to the first exemplary embodiment of the present invention described with reference to FIG. 2, except for the fourth TFT T4, so descriptions of the driving TFT DT, organic light emitting diode OLED, first to third TFTS T1, T2, and T3, and first and second capacitors C1 and C2 of the pixel P according to the third exemplary embodiment of the present invention will be omitted.

The fourth TFT T4 is turned on in response to a third scan signal SCAN3 of a third scan line SL3 to connect the second node N2 to a second reference voltage source supplying a second reference voltage REF2. A gate electrode of the fourth TFT T4 is coupled to the third scan line SL3, a source electrode thereof is coupled to the second reference voltage source, and a drain electrode thereof is coupled to the second node N2.

Semiconductor layers of the first to third TFTs T1, T2, and T3 and the driving TFT DT have been described as being formed of an oxide semiconductor, in particular, an oxide semiconductor. However, the present invention is not limited thereto, but the semiconductor layers of the first to third TFTs T1, T2, and T3 and the driving TFT DT may be formed of either a-Si or Poly-Si. Also, the exemplary embodiment of the present invention has been described with respect to an example in which the first to third TFTs T1, T2, and T3 and the driving TFT DT are implemented as N-type MOSFETs (Metal Oxide Semiconductor Field Effect Transistors).

The second reference voltage REF2 may be set to a voltage lower than a differential voltage between the first reference voltage REF1 and the threshold voltage Vth of the driving TFT DT. For example, the high-potential voltage VDD may be set to approximately 20 V, the low-potential voltage VSS may be set to approximately 0 V, the first reference voltage REF1 may be set to approximately −1 V, and the second reference voltage REF2 may be set to approximately −7 V.

Figure 9:
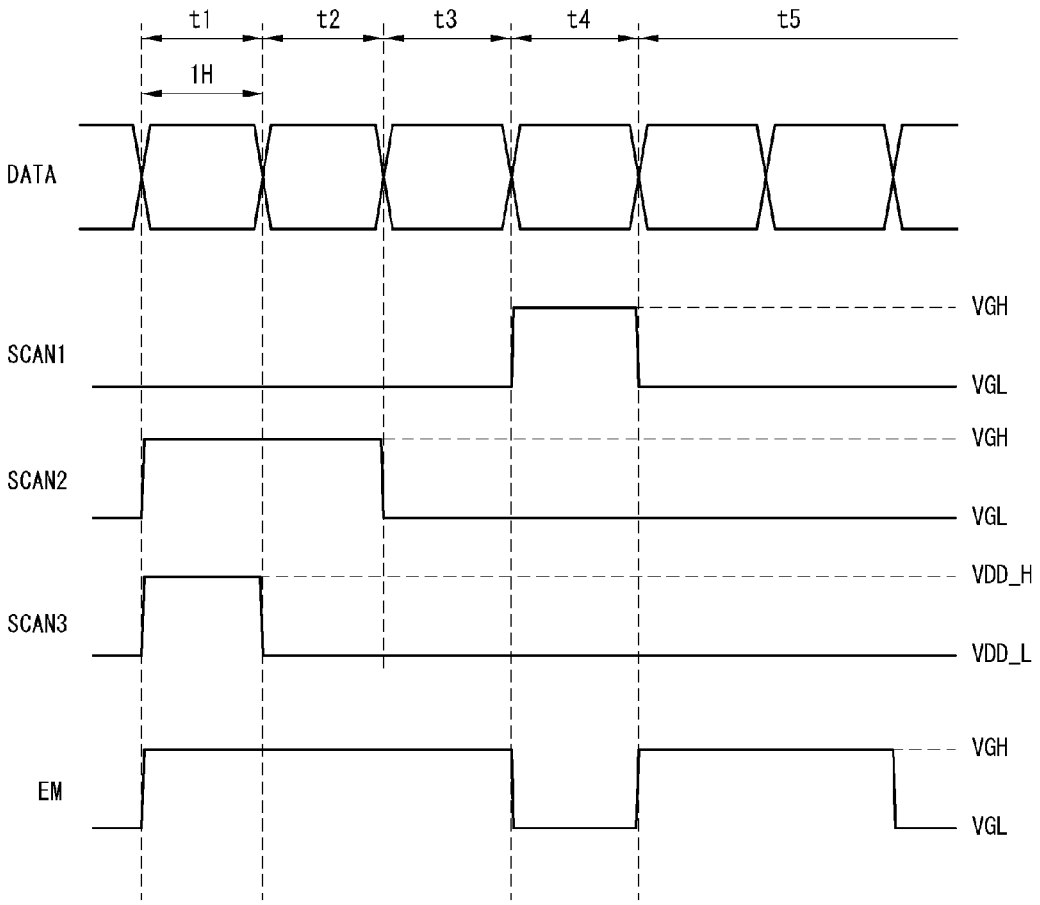
FIG. 9 is a waveform diagram showing signals which are input into a pixel to internally compensate the threshold voltage of a driving TFT.

FIG. 9 is a waveform diagram showing signals which are input into a pixel to internally compensate the threshold voltage of a driving TFT. FIG. 9 depicts first to third scan signals SCAN1, SCAN2, and SCAN3 and an emission signal EM which are input into a certain pixel P of a display panel 10. Also, FIG. 9 depicts a data voltage DATA supplied through a data line DL.

The first and second scan signals SCAN1 and SCAN2, emission signal EM, and data voltage DATA of FIG. 9 are substantially the same as described in FIG. 3, except for the third scan signal SCAN3, so descriptions of the first and second scan signals SCAN1 and SCAN2, emission signal EM, and data voltage DATA will be omitted. Also, it should be noted that the high-potential voltage VDD of FIG. 9 is supplied as a DC high-potential voltage. The high-potential voltage VDD may be set to approximately 20 V.

The third scan signal SCAN3 is a signal for controlling the fourth TFT T4. The third scan signal SCAN3 is generated every frame period. The third scan signal SCAN3 swings between the gate high voltage VGH and the gate low voltage VGL. A pulse of the third scan signal SCAN3 is generated at the gate high voltage VGH.

The pulse start time of the third scan signal SCAN3 is synchronized with the pulse start time of the second scan signal SCAN2. The pulse end time of the third scan signal SCAN3 is earlier than the pulse end time of the second scan signal SCAN2. The pulse width of the second scan signal SCAN2 is larger than the pulse width of the third scan signal SCAN3. For example, the pulse width of the first scan signal SCAN1 may be set to one horizontal period 1H, the pulse width of the second scan signal SCAN2 may be set to two horizontal periods 2H, the pulse width of the third scan signal SCAN3 may be set to one horizontal period 1H, and the first pulse width of the emission signal EM may be set to three horizontal periods 3H.

FIG. 10 is a table showing changes in the voltages of nodes of a pixel. Hereinafter, an operation of the pixel P during t1 to t5 according to an exemplary embodiment of the present invention will be described in detail with reference to FIGS. 8 to 10. t1 is a period during which the first to third nodes N1, N2, and N3 are initialized, t2 and t3 are periods for sensing the threshold voltage of the driving TFT DT, t4 is a period for supplying a data voltage, and t5 is a period during which the organic light emitting diode OLED emits light.

First, during t1, a pulse of the second scan signal SCAN2, a pulse of the third scan signal SCAN3, and a first pulse of the emission signal EM start. That is, during t1, the first scan signal SCAN1 having the gate low voltage VGL is supplied through the first scan line SL1, and the second scan signal SCAN2 having the gate high voltage VGH is supplied through the second scan line SL2. Also, during t1, the third scan signal SCAN3 having the gate high voltage VGH is supplied through the third scan line SL3, and the emission signal EM having the gate high voltage VGH is supplied through the emission line EM.

The first TFT T1 is turned off in response to the first scan signal SCAN1 having the gate low voltage VGL. The second TFT T2 is turned on in response to the second scan signal SCAN2 having the gate high voltage VGH to connect the first node N1 to the first reference voltage source. By the turning on of the second TFT T2, the first node N1 is discharged to the first reference voltage REF1. The third TFT T3 is turned on in response to the emission signal EM of the gate high voltage VGH to connect the second node N2 to the third node N3. The fourth TFT T4 is turned on in response to the third scan signal SCAN3 having the gate high voltage VGH to connect the second node N2 to the second reference voltage. By the turning on of the third and fourth TFTs T3 and T4, the second node N2 and the third node N3 are discharged to the second reference voltage REF2.

Secondly, during t2, the pulse of the second scan signal SCAN2 is sustained, the pulse of the third scan signal SCAN3 ends, and the first pulse of the emission signal EM is sustained. During t3, the pulse of the second scan signal SCAN2 ends, and the first pulse of the emission signal EM is sustained. That is, the first scan signal SCAN1 having the gate low voltage VGL is supplied through the first scan line SL1 during t2 and t3, the second scan signal SCAN2 having the gate high voltage VGH is supplied through the second scan line SL2 during t2, and the second scan signal SCAN2 having the gate low voltage VGL is supplied through the second scan line SL2 during t3. Also, during t2 and t3, the third scan signal SCAN3 having the gate low voltage VGL is supplied through the third scan line S L3, and the emission signal EM having the gate high voltage VGH is supplied through the emission line EML.

The first TFT T1 is turned off in response to the first scan signal SCAN1 having the gate low voltage VGL. When the second scan signal SCAN2 is inverted to the gate low voltage VGL, the second TFT T2 is turned off. By the turning off of the first and second TFTs T1 and T2, the first node N1 is disconnected from the first reference voltage, and the first node N1 floats. The third TFT T3 is turned on in response to the emission signal EM having the gate high voltage VGH to connect the second node N2 to the third node N3. By the turning on of the third TFT T3, the second node N2 and the third node N3 have the same potential. The fourth TFT T4 is turned off in response to the third scan signal SCAN3 having the gate low voltage VGL. By the turning off of the fourth TFT T4, the second node N2 is disconnected from the second reference voltage source.

Because the voltage difference Vgs between the gate and source electrodes of the driving TFT DT is greater than the threshold voltage Vth during t2 and t3, the driving TFT DT forms a current path until the voltage difference Vgs between the gate and source electrodes reaches the threshold voltage Vth. Accordingly, the voltage of the second node N2 rises up to a differential voltage REF1-Vth between the first reference voltage REF1 and the threshold voltage Vth of the driving TFT DT. Moreover, as the third node N3 is coupled to the second node N2 by the turning on of the third TFT T3, the voltage of the third node N3 rises up to the differential voltage REF1-Vth between the first reference voltage REF1 and the threshold voltage Vth of the driving TFT DT.

T3 may be defined as a floating period of the first node N1. As the first node N1 floats during t3, a change in the voltage of the second node N2 may be applied to the first node N1 by a parasitic capacitance existing between the gate electrode and source electrode of the driving TFT DT. Due to this, the voltage of the first node N1 is increased, thereby enhancing the sensing speed of the threshold voltage Vth of the driving TFT DT.

Consequently, the second node N2 and the third node N3 sense the threshold voltage Vth of the driving TFT DT during t2 and t3. Although FIG. 2 has been illustrated with respect to an example in which t2 and t3 corresponding to the threshold voltage sensing period are two horizontal periods, it is to be noted that the present invention is not limited thereto. That is, t2 and t3 may be appropriately set to approximately two or more horizontal periods by a preliminary test, and t3, which is the floating period of the first node N1, may be appropriately set to approximately 1 to several tens of horizontal periods by a preliminary test. A detailed description thereof will be described later with reference to FIG. 11. In the present invention, the threshold voltage Vth of the driving TFT DT is sensed during two or more horizontal periods, and therefore the accuracy of sensing the threshold voltage of the driving TFT DT can be increased even when a large area, high-resolution organic light emitting diode display device is driven at high speed at a frame frequency of 240 Hz or more.

Thirdly, during t4, the first pulse of the emission signal EM ends, and a pulse of the first scan signal SCAN1 starts. That is, during t4, the first scan signal SCAN1 having the gate high voltage VGH is supplied through the first scan line SL1, and the second scan signal SCAN2 having the gate low voltage VGL is supplied through the second scan line SL2. During t4, the third scan signal SCAN3 having the gate low voltage VGL is supplied through the third scan line SL3, and the emission signal EM having the gate low voltage VGL is supplied through the emission line EML.

The first TFT T1 is turned on in response to the first scan signal SCAN1 having the gate high voltage VGH to connect the first node N1 to the data line DL. The second TFT T2 is turned off in response to the second scan signal SCAN2 having the gate low voltage VGL. By the turning on of the first TFT T1, the first node N1 is charged with the data voltage DATA. The third TFT T3 is turned off in response to the emission signal EM having the gate low voltage VGL. By the turning off of the third TFT T3, the second node N2 is disconnected from the third node N3, and the third node N3 floats. The fourth TFT T4 is turned off in response to the third scan signal SCAN3 having the gate low voltage VGL. By the turning off of the fourth TFT T4, the second node N2 is disconnected from the second reference voltage source.

As the third node N3 floats during t4, a change in the voltage of the first node N1 is applied to the third node N3 by the first capacitor C1. That is, 'REF1−DATA', the change in the voltage of the first node N1, is applied to the third node N3. However, the third node N3 is coupled between the first and second capacitors C1 and C2 coupled in series. Hence, the voltage change is applied in the ratio of C' as shown in Equation 2. As a consequence, 'C'(REF1−DATA)' is applied to the third node N3, and therefore the voltage of a fourth node N4 is changed to 'REF1−Vth−C'(REF1−DATA)'.

Fourthly, during t5, the pulse of the first scan signal SCAN1 ends, and a second pulse of the emission signal EM is generated. That is, during t5, the first scan signal SCAN1 having the gate low voltage VGL is supplied through the first scan line SL1, the second scan signal SCAN2 having the gate low voltage VGL is supplied through the second scan line SL2, and the third scan signal SCAN3 having the gate low voltage VGL is supplied through the third scan line SL3. Also, the emission signal EM inverted from the gate high voltage VGH to the gate low voltage VGL is supplied through the emission line EML during t5. The emission signal EM is inverted from the gate high voltage VGH to the gate low voltage VGL within approximately 1 to several tens of horizontal period.

The first TFT T1 is turned off in response to the first scan signal SCAN1 having the gate low voltage VGL. The second TFT T2 is turned off in response to the second scan signal SCAN2 having the gate low voltage VGL. By the turning off of the first TFT T1 and the second TFT T2, the first node N1 floats. The third TFT T3 is turned on in response to the emission signal EM having the gate high voltage VGH to connect the second node N2 to the third node N3. By the turning on of the third TFT T3, the voltage of the third node N3 is changed. The third TFT T3 is turned off in response to the emission signal EM inverted from the gate high voltage VGH to the gate low voltage VGL within 1 to several tens of horizontal periods. The fourth TFT T4 is turned off in response to the third scan signal SCAN3 having the gate low voltage VGL. By the turning off of the fourth TFT T4, the second node N2 is disconnected from the second reference voltage source.

As the first node N1 floats during t5, a change in the voltage of the third node N3 is applied to the first node N1 by the first capacitor C1. That is, 'REF1−Vth−C'(REF1−DATA)−Voled_anode', the change in the voltage of the third node N3, is applied to the first node N1. Accordingly, the voltage of the first node N1 is changed to 'DATA−{ReF1−Vth−C'(REF1−DATA)−Voled_anode}'.

The drain-source current Ids of the driving TFT DT supplied to the organic light emitting diode OLED is represented by Equation 3. 'Vgs−Vth' during t5 is as shown in Equation 4. To sum up Equation 4, the drain-source current Ids of the driving TFT DT is derived as in Equation 5. As a consequence, as shown in Equation 5, the drain-source current Ids of the driving TFT DT supplied to the organic light emitting diode OLED during t5 does not depend upon the threshold voltage Vth of the driving TFT DT. That is, the present invention makes it possible to compensate the threshold voltage of the driving TFT DT.

Overall, in the pixel P according to the third exemplary embodiment of the present invention, the second node N2 coupled to the source electrode of the driving TFT DT is initialized to the high-potential voltage VDD_L of low level during an initialization period (t1). The high-potential voltage VDD_L of low level is set to a voltage lower than the differential voltage between the first reference voltage REF1 and the threshold voltage Vth of the driving TFT DT. As a result, the pixel P according to the third exemplary embodiment of the present invention allows the voltage difference Vgs between the gate and source electrodes of the driving TFT DT to be greater than the threshold voltage Vth during the threshold voltage sensing period (t2 and t3), even if the threshold voltage Vth of the driving TFT DT is shifted to a negative voltage. Due to this, the driving TFT DT forms a current path until the voltage difference Vgs between the gate and source electrodes reaches the threshold voltage Vth. Accordingly, the voltage of the second node N2 rises up to a differential voltage REF1-Vth between the first reference voltage REF1 and the threshold voltage Vth of the driving TFT DT. Therefore, even if the threshold voltage Vth of the driving TFT DT is shifted to a negative voltage, the second node N2 can sense the threshold voltage Vth.

Figure 11:
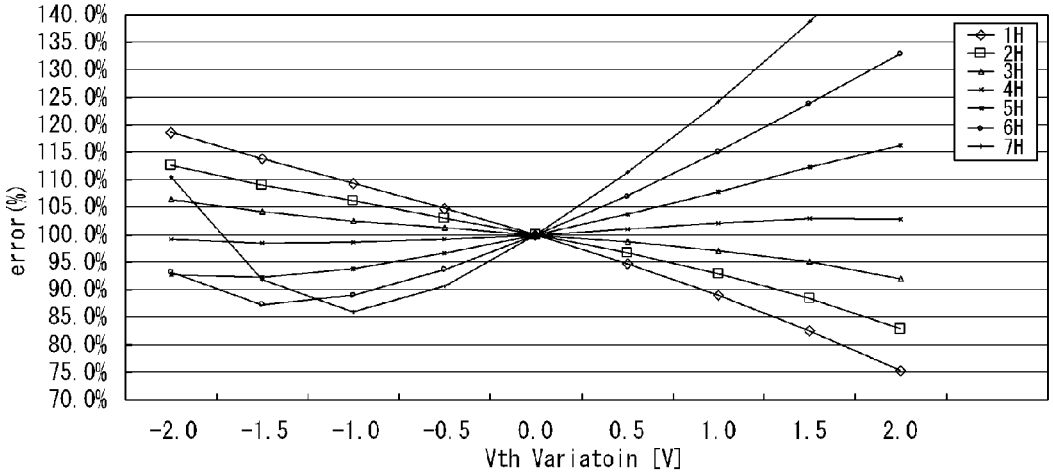
FIG. 11 is a graph showing a threshold voltage compensation error vs. a change in the threshold voltage of a driving TFT for each threshold voltage sensing period of the pixel according to the third exemplary embodiment of the present invention.

FIG. 11 is a graph showing a threshold voltage compensation error vs. a change in the threshold voltage of a driving TFT for each threshold voltage sensing period of the pixel according to the third exemplary embodiment of the present invention. Referring to FIG. 11, a threshold voltage variation range (Vth variation) of the driving TFT DT is shown on the x-axis, and an error of the drain-source current of the driving TFT DT supplied to the organic light emitting diode OLED is shown on the y-axis.

FIG. 11 depicts an error in the drain-source current Ids of the driving TFT DT when a floating period t3 of the first node N, out of the threshold voltage sensing period t2 and t3 of the driving TFT, corresponds to one to seven horizontal periods 1H, 2H, 3H, 4H, 5H, 6H, and 7H. When the floating period t3 of the first node N1 corresponds to one horizontal period 1H, the error occurs approximately at −25% to 18%. When the floating period t3 of the first node N1 corresponds to two horizontal periods 2H, the error occurs approximately at −17% to 13%. When the floating period t3 of the first node N1 corresponds to three horizontal periods 3H, the error occurs approximately at −6% to 9%. When the floating period t3 of the first node N1 corresponds to four horizontal periods 4H, the error occurs approximately at −2% to 3%. When the floating period t3 of the first node N1 corresponds to five horizontal periods 5H, the error occurs approximately at −7% to 16%. When the floating period t3 of the first node N1 corresponds to six horizontal periods 6H, the error occurs approximately at −12% to 33%. That is, the floating period t3 of the first node N1 allows for improved sensing speed of the threshold voltage Vth of the driving TFT DT. Accordingly, in the third exemplary embodiment of the present invention, if the floating period t3 of the first node N1 is set to four horizontal periods 4H, as show in FIG. 11, the accuracy of sensing the threshold voltage of the driving TFT DT can be improved, and therefore an error in the drain-source current Ids of the driving TFT DT can be minimized.

Figure 12:
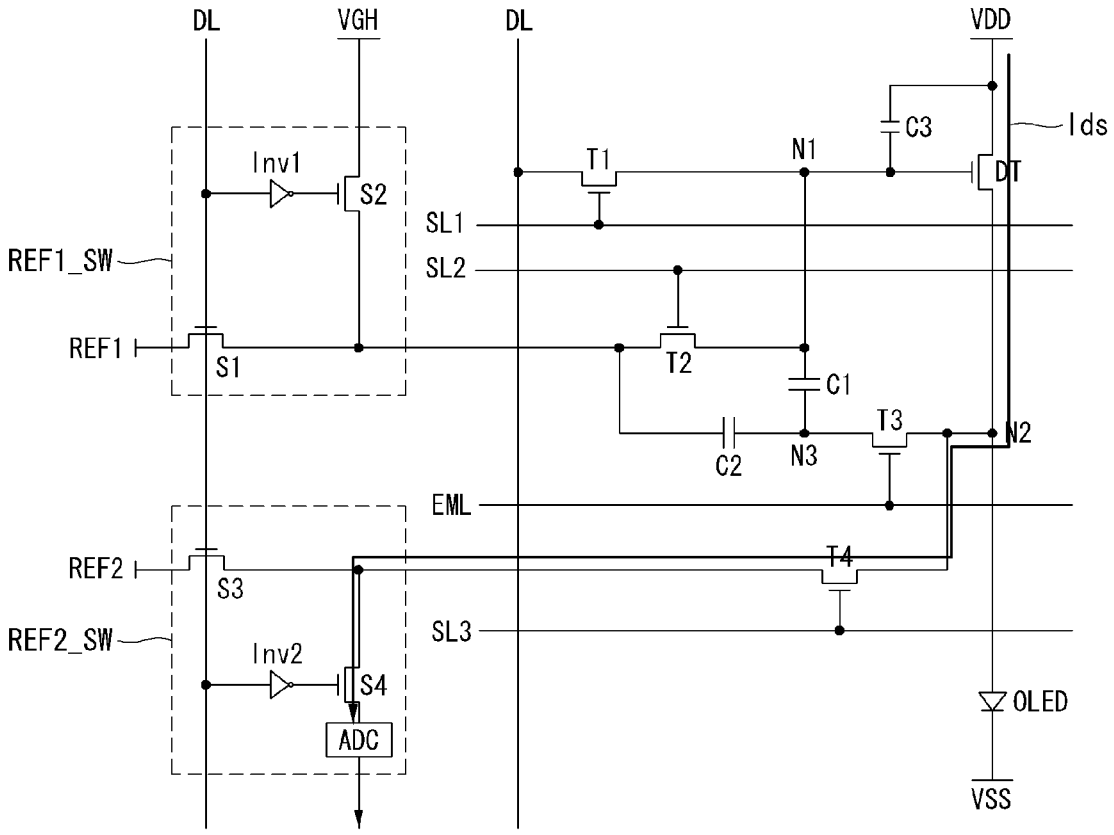
FIG. 12 is a view showing a current flow through a pixel in the case of external compensation of a driving TFT.

FIG. 12 is a view showing a current flow through a pixel in the case of external compensation of a driving TFT. FIG. 12 depicts a current path for sensing the threshold voltage Vth, electron mobility, etc of the driving TFT DT when the threshold voltage Vth of the driving TFT DT is compensated by an external compensation method.

Referring to FIG. 12, an organic light emitting diode display according to the present invention further comprises a first reference voltage switching circuit REF1_SW and a second reference voltage switching circuit ReF2_SW to externally compensate the threshold voltage Vth, electron mobility, etc of the driving TFT DT.

The first reference voltage switching circuit REF1_SW comprises first and second switches S1 and S2 and a first inverter Inv1. The first switch S1 is turned on in response to a control signal CTRL supplied from a control line CL to connect a first reference voltage line RL1 to the first reference voltage source. A gate electrode of the first switch S1 is coupled to the control line CL, a source electrode thereof is coupled to the first reference voltage source, and a drain electrode thereof is coupled to the first reference voltage line RL. The second switch S2 is turned on in response to an inversion signal of the control signal CTRL to connect the first reference voltage line RL1 to a gate high voltage source supplying a gate high voltage VGH. A gate electrode of the second switch S2 is coupled to the first inverter Inv1, a source electrode thereof is coupled to the gate high voltage source, and a drain electrode thereof is coupled to the first reference voltage line RL1. The first inverter Inv1 inverts the control signal CTRL supplied from the control line CL. The first inverter Inv1 is coupled between the control line CL and the gate electrode of the second switch S2.

The second reference voltage switching circuit REF2_SW comprises third and fourth switches S3 and S4 and a current sensing circuit ADC. The third switch S3 is turned on in response to a control signal CTRL supplied from the control line CL to connect a second reference voltage line RL2 to a second reference voltage source. A gate electrode of the third switch S3 is coupled to the control line CL, a source electrode thereof is coupled to the second reference voltage source, and a drain electrode thereof is coupled to the second reference voltage line RL2. The fourth switch S4 is turned in response to the inversion signal of the control signal CTRL supplied from the control line CL to connect the second reference voltage line RL2 to the current sensing circuit ADC. A gate electrode of the fourth switch S4 is coupled to the second inverter Inv2, a source electrode thereof is coupled to the current sensing circuit ADC, and a drain electrode thereof is coupled to the second reference voltage line RL2. The second inverter Inv2 inverts the control signal CTRL supplied from the control line CL. The second inverter Inv2 is coupled between the control line CL and the gate electrode of the fourth switch S4.

The first to fourth switches S1, S2, S3, and S4 of FIG. 12 have been described as being formed of TFTs. However, the present invention is not limited thereto. Also, although FIG. 12 illustrates the gate high voltage source, the gate high voltage source may be replaced with other power sources for turning on the driving TFT DT.

Figure 13:
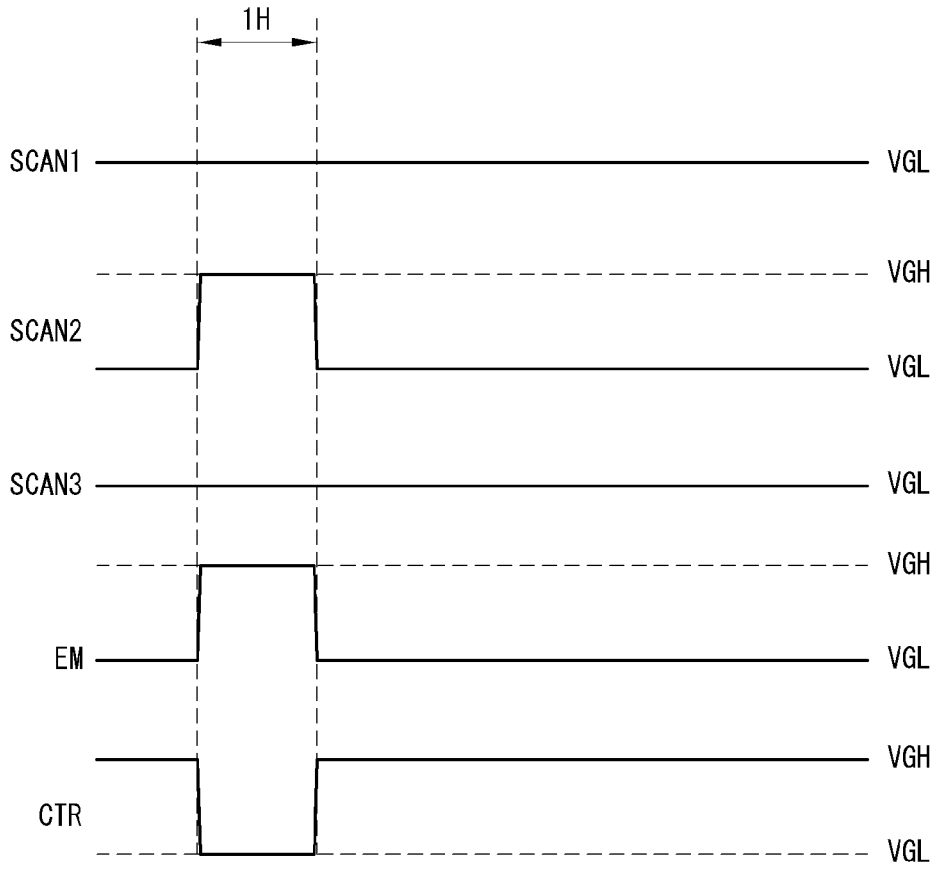
FIG. 13 is a waveform diagram showing signals which are input into a pixel to externally compensate the threshold voltage of a driving TFT.

FIG. 13 is a waveform diagram showing signals which are input into a pixel to externally compensate the threshold voltage of a driving TFT. FIG. 13 depicts first to third scan signals SCAN1, SCAN2, and SCAN3, an emission signal EM, and a control signal CTRL which are input into a certain pixel P of the display panel 10.

Referring to FIG. 13, the first to third scan signals SCAN1, SCAN2, and SCAN3, the emission signal EM, and the control signal CTRL each swing between a gate high voltage VGH and a gate low voltage VGL. Pulses of the first to third scan signals SCAN1, SCAN2, and SCAN3 and the emission signal EM are generated at the gate high voltage VGH. A pulse of the control signal CTRL is generated at the gate low voltage VGL.

In the case of external compensation of the driving TFT DT, pulses are generated from the second and third scan signals SCAN2 and SCAN3 and the control signal CTRL, whereas no pulses are generated from the first scan signal SCAN1 and the emission signal EM. The pulses of the second and third scan signals SCAN2 and SCAN3 and the control signal CTRL are generated in synchronization with each other. It should be noted that although FIG. 13 illustrates pulses of the second and third scan signals SCAN2 and SCAN3 and control signal CTRL as being generated during approximately one horizontal period 1H, the present invention is not limited thereto. On the other hand, in the case of internal compensation of the threshold voltage Vth of the driving TFT DT, no pulse is generated from the control signal, and the control signal is maintained at the gate high voltage VGH.

Hereinafter, a method for sensing the drain-source current Ids of the driving TFT DT in the case of external compensation of the driving TFT DT will be described with reference to FIGS. 12 and 13.

In the case of external compensation of the driving TFT DT, the first scan signal SCANT having the gate low voltage VGL is supplied through the first scan line SL1, and the second scan signal SCAN2 having the gate high voltage VGH is supplied through the second scan line SL2. Also, the third scan signal SCAN3 having the gate high voltage VGH is supplied through the third scan lien SL3, and the emission signal EM having the gate low voltage VGL is supplied through the emission line EML. Also, the control signal CTRL having the gate low voltage VGL is supplied through the control line CL.

The first switch 51 is turned off in response to the control signal CTRL having the gate low voltage VGL, and the second switch S2 is turned on in response to the inversion signal of the control signal CTRL. By the turning off of the first switch 51 and the turning on of the second switch S2, the gate high voltage source is coupled to the first reference voltage line RL1. Accordingly, the gate high voltage VGH is supplied to the first reference voltage line RL1.

The third switch S3 is turned off in response to the control signal CTRL having the gate low voltage VGL, and the fourth switch S4 is turned on in response to the inversion signal of the control signal CTRL. By the turning off of the third switch S3 and the turning on of the fourth switch S4, the second reference voltage line RL2 is coupled to the current sensing circuit ADC. Accordingly, the second reference voltage line RL2 functions to sense the drain-source current Ids of the driving TFT DT.

The first TFT T1 is turned off in response to the first scan signal SCAN1 having the gate low voltage VGL, and the second TFT T2 is turned on in response to the second scan signal SCAN2 having the gate high voltage VGH. By the turning off of the first TFT T1 and the turning on of the second TFT T2, the first node N1 is charged with the gate high voltage VGH. The driving TFT DT is turned on in response to the gate high voltage VGH. The third TFT T3 is turned off in response to the emission signal EM having the gate low voltage VGL, and the fourth TFT T4 is turned on in response to the third scan signal SCAN3 having the gate high voltage VGH. By the turning off of the third TFT T3 and the turning on of the fourth TFT T4, the drain-source current Ids of the driving TFT DT flows toward the reference voltage line RL2 through the second node N2. As a result, the present invention makes it possible to sense the drain-source current Ids of the driving TFT DT by connecting the second reference voltage line RL2 to the current sensing circuit ADC in the case of external compensation of the driving TFT DT, and therefore compensates the threshold voltage Vth, electron mobility, etc of the driving TFT DT by an external compensation method. A detailed description of the external compensation method will be given later in conjunction with FIGS. 16 and 17.

Figure 14:
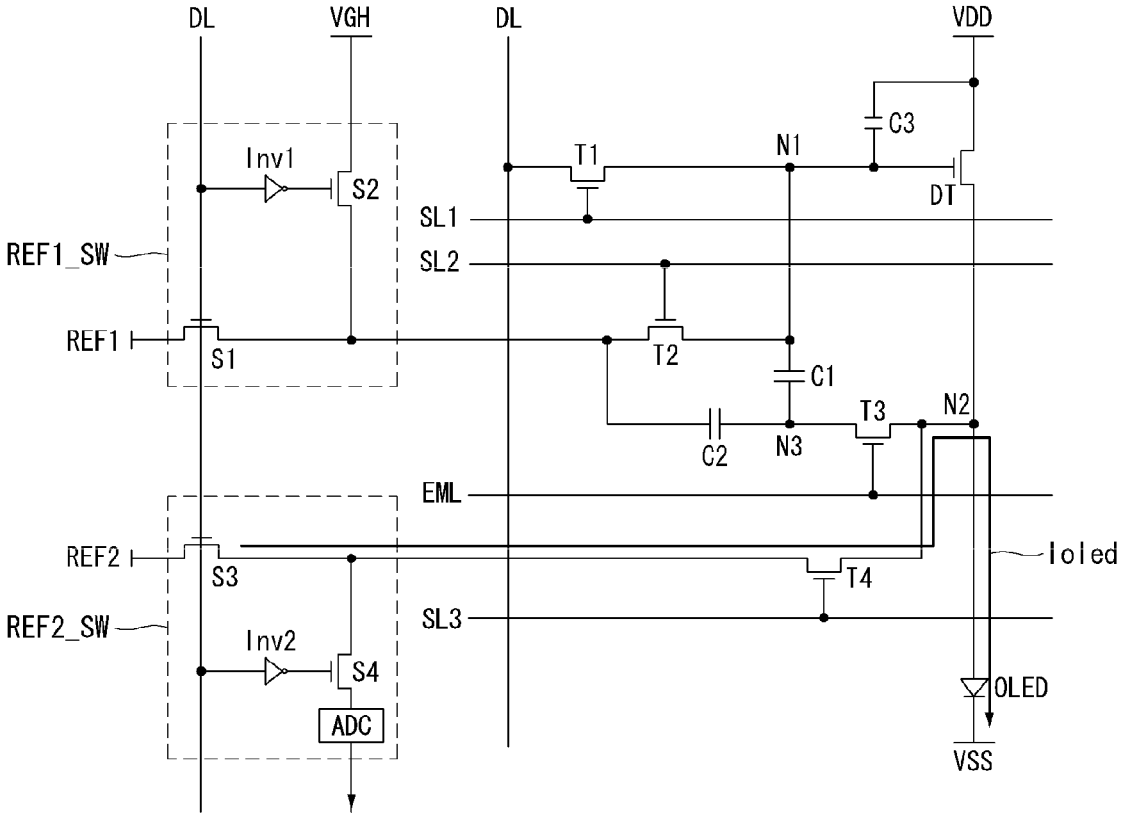
FIG. 14 is a view showing a current flow through a pixel in the case of external compensation of an organic light emitting diode.

FIG. 14 is a view showing a current flow through a pixel in the case of external compensation of an organic light emitting diode. FIG. 14 depicts a current path for sensing the threshold voltage Vth, electron mobility, etc of the organic light emitting diode OLED when the threshold voltage Vth of the organic light emitting diode OLED is compensated by an external compensation method.

Referring to FIG. 14, an organic light emitting diode display according to the present invention further comprises a first reference voltage switching circuit REF1_SW and a second reference voltage switching circuit REF2_SW to externally compensate the organic light emitting diode.

The first reference voltage switching circuit REF1_SW and the second reference voltage switching REF2_SW of FIG. 14 are substantially the same as described in FIG. 12, except for the gate low voltage source of the first reference voltage switching circuit REF1_SW, so descriptions of the first reference voltage switching circuit REF1_SW and the second reference voltage switching circuit REF2_SW will be omitted. In FIG. 14, the gate low voltage source supplies the gate low voltage VGL, and may be replaced with other power sources for completely turning off the driving TFT DT.

Moreover, a waveform diagram of signals which are input into a pixel to internally compensate the threshold voltage is substantially the same as described in FIG. 13. Referring to FIG. 13 and FIG. 14, a method for sensing the current Ioled of the organic light emitting diode OLED in the case of external compensation of the organic light emitting diode OLED will be described below.

The method for sensing the current Ioled of the organic light emitting diode is substantially the same as described in conjunction with FIG. 12 and FIG. 13, except for the use of the gate low voltage source, so a description thereof will be omitted.

Referring to FIGS. 13 and 14, the gate low voltage source is coupled to the first reference voltage line RL1 by the turning off of the first switching 51 and the turning on of the second switch S2. Accordingly, the gate low voltage VGL is supplied to the first reference voltage line RL1. Also, by the turning off of the first TFT T1 and the turning on of the second TFT T2, the first node N1 is charged with the gate low voltage VGL. The driving TFT DT is completely turned off in response to the gate low voltage VGL. Also, by the turning off of the third TFT T3 and the turning on of the fourth TFT T4, the current Ioled of the organic light emitting diode OLED flows to a low-potential voltage source through the second reference voltage line RL2, the second node N2, and the organic light emitting diode OLED. As a result, the present invention makes it possible to sense the current Ioled of the organic light emitting diode by connecting the second reference voltage line RL2 to the current sensing circuit ADC in the case of external compensation of the organic light emitting diode OLED, and therefore compensates the threshold voltage Vth of the organic light emitting diode OLED by an external compensation method. A detailed description of the external compensation method will be given later in conjunction with FIGS. 16 and 17.

Figure 15:
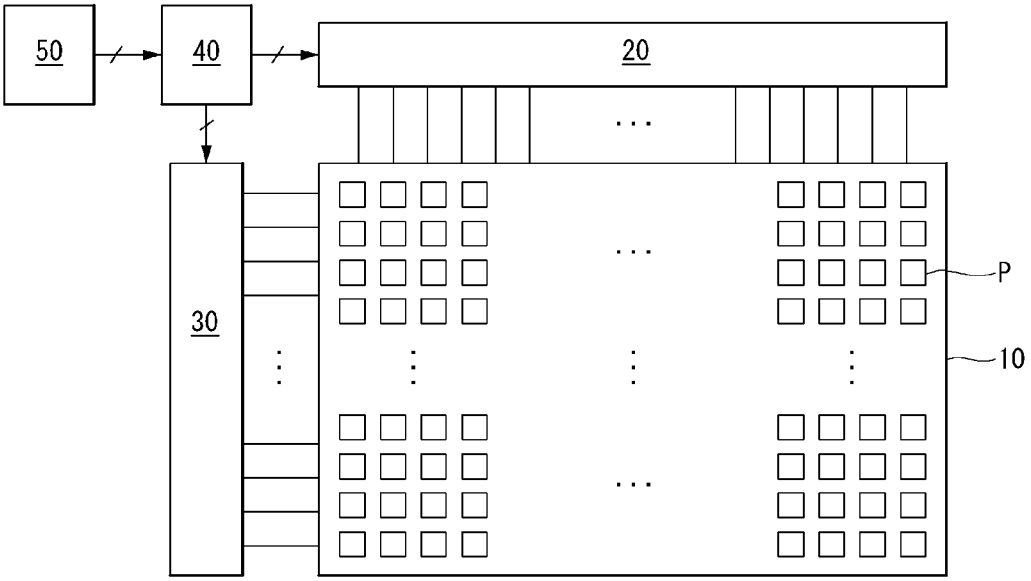
FIG. 15 is a block diagram schematically showing an organic light emitting diode display device according to an exemplary embodiment of the present invention.

FIG. 15 is a block diagram schematically showing an organic light emitting diode display device according to an exemplary embodiment of the present invention. Referring to FIG. 15, the organic light emitting diode display device according to the exemplary embodiment of the present invention comprises a display panel 10, a data driver 20, a scan driver 30, a timing controller 40, and a host system 50.

Data lines DL and first scan lines SL1 crossing each other are formed on the display panel 10. Second scan lines SL2 and emission lines EML are formed in parallel with the first scan lines SL1 on the display panel 10. Control lines CL may be formed on the display panel 10. Also, pixels P are arranged in a matrix form on the display panel 10. Each of the pixels P of the display panel 10 is as described in conjunction with FIG. 2, FIG. 6, and FIG. 8.

The data driver 20 comprises a plurality of source drive ICs. The source drive ICs receive digital video data RGB' from the timing controller 40, the digital video data RGB' comprising a compensated threshold voltage Vth and electron mobility of a driving TFT DT and a compensated threshold voltage of an organic light emitting diode OLED. The source drive ICs convert the compensated digital video data RGB' into a gamma compensation voltage in response to a source timing control signal DCS from the timing controller 40 to generate a data voltage and supply the data voltage to the data lines DL of the display panel 10 in synchronization with a first scan signal SCAN1.

The scan driver 30 comprises a first scan signal output part, a second scan signal output part, a third scan signal output part, an emission signal output part, and a control signal output part. The first scan signal output part sequentially outputs the first scan signal SCAN1 to the first scan lines SL1 of the display panel 10. The second scan signal output part sequentially outputs a second scan signal SCAN2 to the second scan lines SL2. The third scan signal output part outputs a control signal MG to the third scan lines SL3. The emission signal output part sequentially outputs an emission signal EM to the emission lines EML of the display panel 10. The control signal output part sequentially outputs a control signal CTR to the control lines CL of the display panel 10. Detailed descriptions of the first to third scan signals SCAN1, SCAN2, and SCAN3, the emission signal EM, and the control signal CTR will be described in detail in conjunction with FIG. 4, FIG. 9, and FIG. 13.

The timing controller 40 receives digital video data RGB from the host system 50 through a low voltage differential signaling (LVDS) interface, a transition minimized differential signaling (TMDS) interface, etc. The timing controller 40 may comprise an external compensator for externally compensating the threshold voltage Vth and electron mobility of the driving TFT and the threshold voltage Vth of the organic light emitting diode OLED. The external compensator 40 applies compensated data, which is calculated using an external compensation method, to the digital video data RGB input from the host system 50, and outputs compensated digital video data RGB' to the data driver 20.

The timing controller 40 receives timing signals such as a vertical synchronization signal, a horizontal synchronization signal, a data enable signal, and a dot clock, and generates timing control signals for controlling operation timings of the data driver 20 and scan driver 30 based on the timing signals from the host system 50. The timing control signals comprise a scan timing control signal for controlling the operation timing of the scan driver 30 and a data timing control signal for controlling the operation timing of the data driver 20. The timing controller 40 outputs the scan timing control signal to the scan driver 30, and outputs the data timing control signal to the data driver 20.

The display panel 10 may further comprise a power supply unit (not shown). The power supply unit supplies a high-potential voltage VDD, a low-potential voltage VSS, a first reference voltage REF1, and a second reference voltage REF2 to the display panel 10. Further, the power supply unit supplies a gate high voltage VGH and a gate low voltage VGL to the scan driver 30.

Figure 16:
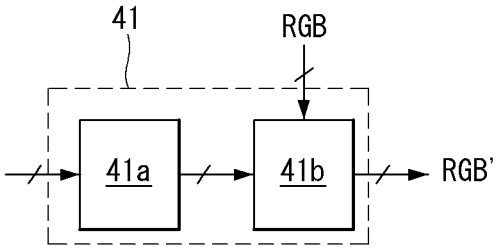
FIG. 16 is a block diagram showing an external compensator of a timing controller.
Figure 17:
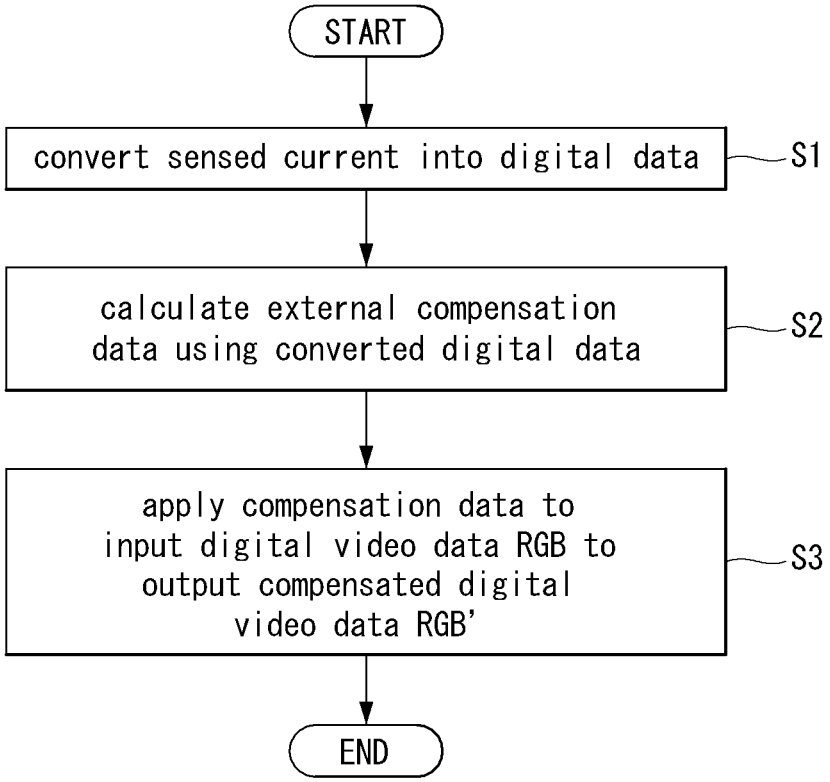
FIG. 17 is a flowchart showing an external compensation method according to an exemplary embodiment of the present invention.

FIG. 16 is a block diagram showing an external compensator of a timing controller. FIG. 17 is a flowchart showing an external compensation method according to an exemplary embodiment of the present invention. Referring to FIG. 16, the external compensator 41 of the timing controller 40 comprises a compensation data calculator 41*a* and a compensated digital video data output part 41*b*. An external compensation method of the external compensator 41 according to the exemplary embodiment will be schematically described below with reference to FIG. 16 and FIG. 17, Firstly, the drain-source current Ids of the driving TFT DT of each of the pixels P and the current Ioled of the organic light emitting diode OLED thereof are sensed by using a current sensing circuit ADC coupled to the second reference voltage line RL2 of each of the pixels P of the display panel 10. The sensing of the drain-source current Ids of the driving TFT DT using the current sensing circuit ADC has been described in detail in conjunction with FIG. 12 and FIG. 13. The sensing of the current Ioled of the organic light emitting diode OLED using the current sensing circuit ADC has been described in detail in conjunction with FIG. 13 and FIG. 14. The current sensing circuit ADC converts sensed current into digital data, and outputs the converted digital data to the compensation data calculator 41*a* of the external compensator 41 (S1).

Secondly, the compensation data calculator 41*a* calculates external compensation data by using the digital data input from the current sensing circuit ADC. The compensation data calculator 41*a* can calculate external compensation data, which comprises a compensated threshold voltage Vth and electron mobility of the driving TFT DT and a compensated threshold voltage Vth of the organic light emitting diode, based on the input digital data by using a well-known external compensation calculation method (S2).

Thirdly, the compensated digital video data output part 41*b* receives digital video data RGB from the host system 50, and receives the external compensation data from the compensation data calculator 41*a*. The compensated digital video data output part 41*b* applies the external compensation data to the input digital video data RGB to generate compensated digital video data RGB'. The compensation digital video data output part 41*b* outputs the compensated digital video data RGB' to the data driver 20 (S3).

As discussed above, in the present invention, a gate node of a driving TFT is initialized to a first reference voltage during an initialization period, and a source node of the driving TFT is initialized to a high-potential voltage of low level. The high-potential voltage of low level is set to a voltage lower than a differential voltage between the first reference voltage and the threshold voltage of the driving TFT. Alternatively, in the present invention, the source node of the driving TFT is initialized to a second reference voltage during the initialization period. At this point, the second reference voltage is set to a voltage lower than the differential voltage between the first reference voltage and the threshold voltage of the driving TFT. As a result, the present invention allows the voltage difference between the gate and source of the driving TFT to be greater than the threshold voltage during a threshold voltage sensing period, even if the threshold voltage of the driving TFT is shifted to a negative voltage. Therefore, the threshold voltage can be sensed by using the source node of the driving TFT.

Moreover, in the present invention, the drain-source current of the driving TFT and the current of the organic light emitting diode can be sensed by using the second reference voltage line. As a result, the present invention can externally compensate the sensed current by an external compensation method. Therefore, the electron mobility of the driving TFT and the threshold voltage of the organic light emitting diode, as well as the threshold voltage of the driving TFT, can be compensated.

Furthermore, in the present invention, a period for sensing the threshold voltage of the driving TFT comprises a period for allowing the gate node of the driving TFT to float. As a result, the present invention provides enhanced sensing speed of the threshold voltage of the driving TFT by using the period for allowing the gate node of the driving TFT to float.

In addition, in the present invention, a capacitor is coupled between the high-potential voltage source and the gate node of the driving TFT. As a result, the present invention prevents an increase in the voltage of the gate node of the driving TFT during the period in which the gate node of the driving TFT floats, thereby enhancing black grayscale representation capability. Due to this, the present invention offers a higher contrast ratio.

Besides, in the present invention, the threshold voltage of the driving TFT is sensed during two or more horizontal periods. As a result, the present invention makes it possible to accurately sense the threshold voltage of the driving TFT even when a large area, high-resolution organic light emitting diode display device is driven at high speed at a frame frequency of 240 Hz or more.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising a display panel having a data line, a first scan line, a second scan line, and an emission line formed thereon and a plurality of pixels arranged in a matrix form, each of the pixels comprising:

a driving thin film transistor (TFT) comprising a gate electrode directly coupled to a first node, a source electrode directly coupled to a second node, and a drain electrode coupled to a high-potential voltage source supplying a high-potential voltage;

an organic light emitting diode comprising an anode directly coupled to the second node and a cathode coupled to a low-potential voltage source supplying a low-potential voltage;

a first TFT that is turned on in response to a first scan signal of the first scan line to connect the first node to the data line;

a second TFT that is turned on in response to a second scan signal of the second scan line to connect the first node to a first reference voltage source supplying a first reference voltage, the second TFT being directly coupled to the first node;

a third TFT that is turned on in response to an emission signal of the emission line to connect the second node to a third node;

a first capacitor directly coupled between the first node and the third node; and a second capacitor coupled between the third node and the first reference voltage source.

2. The organic light emitting diode display device of claim 1, wherein the high-potential voltage source supplies the high-potential voltage swinging between a high level and a low level, and the high-potential voltage of low level is a voltage lower than a differential voltage between the first reference voltage and the threshold voltage of the driving TFT.

3. The organic light emitting diode display device of claim 2, wherein the pulse start time of the second scan signal is synchronized with the first pulse start time of the emission signal, the pulse end time of the second scan signal is earlier than the first pulse end time of the emission signal, the first pulse end time the emission signal is synchronized with the pulse start time of the first scan signal, and the second pulse start time of the emission signal is synchronized with the pulse end time of the first scan signal.

4. The organic light emitting diode display device of claim 3, wherein the second pulse of the emission signal is generated during several to several tens of horizontal periods.

5. The organic light emitting diode display device of claim 3, wherein the high-potential voltage source supplies a low-level voltage since the pulse start time of the second scan signal, and supplies a high-level voltage after a point in time earlier than the pulse end time of the second scan signal SCAN2.

6. The organic light emitting diode display device of claim 2, wherein the pulse width of the second scan signal is larger than the pulse width of the first scan signal, and the first pulse width of the emission signal is larger than the pulse width of the second scan signal.

7. The organic light emitting diode display device of claim 1, wherein a gate electrode of the first TFT is coupled to the first scan line, a source electrode thereof is coupled to the first node, and a drain electrode thereof is coupled to the data line, a gate electrode of the second TFT is coupled to the second scan line, a source electrode thereof is coupled to the first reference voltage source, and a drain electrode thereof is coupled to the first node, and a gate electrode of the third TFT is coupled to the emission line, a source electrode thereof is coupled to the third node, and a drain electrode thereof is coupled to the second node.

8. The organic light emitting diode display device of claim 1, wherein each of the pixels further comprises a third capacitor coupled between the first node and the high-potential voltage source.

9. The organic light emitting diode display device of claim 1, wherein a third scan line is formed on the display panel, and each of the pixels further comprises a fourth TFT that is turned on in response to a third scan signal of the third scan line to connect the second node to a second reference voltage source supplying a second reference voltage.

10. The organic light emitting diode display device of claim 9, wherein the second reference voltage is set to a voltage lower than the differential voltage between the first reference voltage and the threshold voltage of the driving TFT.

11. The organic light emitting diode display device of claim 10, wherein the pulse start time of the second scan signal is synchronized with the pulse start time of the third scan signal and the first pulse start time of the emission signal, the pulse end time of the third scan signal is earlier than the pulse end time of the second scan signal, the pulse end time of the second scan signal is earlier than the first pulse end time of the emission signal, the first pulse end time of the emission signal is synchronized with the pulse start time of the first scan signal, and the second pulse start time of the emission signal is synchronized with the pulse end time of the first scan signal.

12. The organic light emitting diode display device of claim 11, wherein the second pulse of the emission signal is generated during several to several tens of horizontal periods.

13. The organic light emitting diode display device of claim 10, wherein the pulse width of the second scan signal is larger than the pulse width of the first scan signal and the pulse width of the third scan signal, and the first pulse width of the emission signal is larger than the pulse width of the second scan signal.

14. The organic light emitting diode display device of claim 9, wherein a gate electrode of the first TFT is coupled to the first scan line, a source electrode thereof is coupled to the first node, and a drain electrode thereof is coupled to the data line, a gate electrode of the second TFT is coupled to the second scan line, a source electrode thereof is coupled to the first reference voltage source, and a drain electrode thereof is coupled to the first node, a gate electrode of the third TFT is coupled to the emission line, a source electrode thereof is coupled to the third node, and a drain electrode thereof is coupled to the second node, and a gate electrode of the fourth TFT is coupled to the third scan line, a source electrode thereof is coupled to the second reference voltage source, and a drain electrode thereof is coupled to the second node.

15. The organic light emitting diode display device of claim 9, wherein a control line is formed on the display panel, and the display panel further comprises:

a first switch that is turned on in response to a control signal of the control line to connect a first reference voltage line to the first reference voltage source;

a second switch that is turned on in response to an inversion signal of the control signal to connect the first reference voltage line to a gate high voltage source;

a third switch that is turned on in response to the control signal to connect a second reference voltage line to the second reference voltage source; and a fourth switch that is turned on in response to the inversion signal of the control signal to connect the second reference voltage line to a current sensing circuit.

16. The organic light emitting diode display device of claim 15, wherein pulses of the second scan signal, third scan signal, and control signal are generated in synchronization with each other, and no pulses are generated from the first scan signal and the emission signal.

17. The organic light emitting diode display device of claim 15, wherein a gate electrode of the first switch is coupled to the control line, a source electrode thereof is coupled to the first reference voltage source, and a drain electrode thereof is coupled to the first reference voltage line, a gate electrode of the second switch is coupled to a first inverter for inverting the control signal, a source electrode thereof is coupled to the first reference voltage line, and a drain electrode thereof is coupled to the gate high voltage source, a gate electrode of the third switch is coupled to the control line, a source electrode thereof is coupled to the second reference voltage source, and a drain electrode thereof is coupled to the second reference voltage line, and a gate electrode of the fourth switch is coupled to a second inverter for inverting the control signal, a source electrode thereof is coupled to the current sensing circuit, and a drain electrode thereof is coupled to the second reference voltage line.

18. The organic light emitting diode display device of claim 9, wherein a control line is formed on the display panel, and the display panel further comprises:

a first switch that is turned on in response to a control signal of the control line to connect a first reference voltage line to the first reference voltage source;

a second switch that is turned on in response to an inversion signal of the control signal to connect the first reference voltage line to a gate low voltage source;

a third switch that is turned on in response to the control signal to connect a second reference voltage line to the second reference voltage source; and a fourth switch that is turned on in response to the inversion signal of the control signal to connect the second reference voltage line to a current sensing circuit.

19. The organic light emitting diode display device of claim 18, wherein pulses of the second scan signal, third scan signal, and control signal are generated in synchronization with each other, and no pulses are generated from the first scan signal and the emission signal.

20. The organic light emitting diode display device of claim 18, wherein a gate electrode of the first switch is coupled to the control line, a source electrode thereof is coupled to the first reference voltage source, and a drain electrode thereof is coupled to the first reference voltage line, a gate electrode of the second switch is coupled to a first inverter for inverting the control signal, a source electrode thereof is coupled to the gate high voltage source, and a drain electrode thereof is coupled to the first reference voltage line, a gate electrode of the third switch is coupled to the control line, a source electrode thereof is coupled to the second reference voltage source, and a drain electrode thereof is coupled to the second reference voltage line, and a gate electrode of the fourth switch is coupled to a second inverter for inverting the control signal, a source electrode thereof is coupled to the current sensing circuit, and a drain electrode thereof is coupled to the second reference voltage line.

21. The organic light emitting diode display of claim 1, wherein the second TFT provides the first reference voltage to the first node when the second TFT is turned on.

22. The organic light emitting diode display of claim 1, wherein an electrode of the first capacitor is connected to a drain electrode of the second TFT and an electrode of the second capacitor is connected to a source electrode of the second TFT.

* * * * *